US008149192B2

(12) United States Patent
Ishii et al.

(10) Patent No.: US 8,149,192 B2
(45) Date of Patent: Apr. 3, 2012

(54) OPTICAL WRITING IMAGE FORMING DEVICE, CONTROL DEVICE FOR OPTICAL WRITING IMAGE FORMING DEVICE

(75) Inventors: Tsutomu Ishii, Kanagawa (JP); Yasunori Saito, Kanagawa (JP); Shigehiko Sasaki, Kanagawa (JP); Masahiro Sato, Kanagawa (JP); Akira Ichiboshi, Kanagawa (JP); Kyotaro Tomoda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 848 days.

(21) Appl. No.: 12/241,813

(22) Filed: Sep. 30, 2008

(65) Prior Publication Data

US 2009/0184944 A1 Jul. 23, 2009

(30) Foreign Application Priority Data

Jan. 22, 2008 (JP) ..... 2008-011741

(51) Int. Cl.
*G09G 3/34* (2006.01)

(52) U.S. Cl. ..... 345/84; 345/204; 349/2; 349/25

(58) Field of Classification Search ..... 345/204
See application file for complete search history.

(56) References Cited

U.S. PATENT DOCUMENTS 5,943,067 A * 8/1999 Kong ..... 347/2
6,040,880 A * 3/2000 Tsuboi et al. ..... 349/5
6,774,880 B2 * 8/2004 Kobayashi ..... 345/84
6,882,355 B2 * 4/2005 Kobayashi ..... 347/111
7,019,722 B2 * 3/2006 Kobayashi et al. ..... 345/84
7,084,890 B2 * 8/2006 Nose et al. ..... 347/130
2002/0012042 A1 * 1/2002 Kobayashi et al. ..... 347/239
2004/0263700 A1 * 12/2004 Hikichi et al. ..... 349/30
2005/0162500 A1 * 7/2005 Nose et al. ..... 347/118
2006/0001626 A1 * 1/2006 Saito et al. ..... 345/84
2010/0002155 A1 * 1/2010 Yamaguchi et al. ..... 349/12
2010/0053117 A1 * 3/2010 Ishii et al. ..... 345/175

FOREIGN PATENT DOCUMENTS

WO WO 2004/068230 A1 8/2004

* cited by examiner

*Primary Examiner* — Richard Hjerpe
*Assistant Examiner* — Dorothy Harris
(74) *Attorney, Agent, or Firm* — Oliff & Berridge, PLC

(57) ABSTRACT

There is provided an optical writing image forming device including: a positioning section positioning an optically written display medium including a pair of electrodes with at least one of which formed by a group of plural sub-electrodes, a display layer, and a photoconductor layer; a display layer initialization section applying an initialization voltage between the pair of electrodes and irradiating initialization light over the entire region of the photoconductor layer; an optical writing section; a head position identification section; and a writing information erasing section, based on information identified by the head position identification section, erasing in a time-series writing information in the display layer corresponding to the group of the plural sub-electrodes by selecting the sub-electrodes in sequence so that an image writing head does not obstruct light emitted from the initialization light source while the image writing head light source is being returned to a standby position.

9 Claims, 13 Drawing Sheets

OPTICAL WRITING IMAGE FORMING DEVICE, CONTROL DEVICE FOR OPTICAL WRITING IMAGE FORMING DEVICE

CROSS-REFERENCE TO RELATED APPLICATION

This application claims priority under 35 USC 119 from Japanese Patent Application No. 2008-011741 filed on Jan. 22, 2008.

BACKGROUND

1. Technical Field

The present invention relates to an optical writing image forming device and to a control device for an optical writing image forming device.

2. Related Art

A conventional recording element is provided with a display body, a photoconductor body disposed superimposed on the display body, and a pair of electrodes, disposed on each side of the display body and the photoconductor body. At least one of the pair of electrodes is divided into plural sub-electrodes.

Information can be written to the recording element using light while a voltage is applied to each of the sub-electrodes.

Consequently a clear image can be obtained with no noise in the portions of the recording element corresponding to the sub-electrodes to which no voltage is being applied, since no writing is carried out even if external light is incident thereon.

A recording device is provided with a power supply member for applying a voltage to the pair of electrodes of the recording element, with a first light source for writing information to the recording element, and with a second light source used in resetting.

Existing conventional recording devices are flat head recording devices or sheet feed recording devices.

SUMMARY

According to an aspect of the invention, there is provided an optical writing image forming device including:

a positioning section that positions an optically written display medium, the optically written display medium including a pair of electrodes with at least one of which is formed by a group of plural sub-electrodes electrically separated from each other and disposed along one direction, a display layer that changes in reflectance ratio according to voltage applied between the pair of electrodes, and a photoconductor layer capable of voltage modulation by light irradiation, changing the reflectance ratio of the display layer;

a display layer initialization section capable of applying an initialization voltage between the pair of electrodes as well as irradiating initialization light at the same time over the entire region of the photoconductor layer using an initialization light source capable of irradiating, in order to initialize the display layer to give a uniform reflectance ratio in a positioned state by the positioning section;

an optical writing section having an image writing light source head that is capable of scanning movement in a space between the initialization light source and the optically written display medium positioned by the positioning section and that carries out light irradiation according to image information, the optical writing section executing a scanning movement of the image writing light source head along the array direction of the sub-electrode group after the display layer has been given a uniform reflectance ratio by initialization voltage application and light irradiation using the display layer initialization section;

a head position identification section that identifies which of the sub-electrodes corresponds to the image writing light source head during scanning when a case arises in which it is necessary to stop ongoing light irradiation according to image information by the light irradiation section; and a writing information erasing section that, based on information identified by the head position identification section, erases in a time-series at least writing information in the display layer corresponding to the group of the plurality of sub-electrodes by selecting the sub-electrodes in sequence so that the image writing head does not obstruct light emitted from the initialization light source while the image writing head light source is being returned to a standby position.

BRIEF DESCRIPTION OF THE DRAWINGS

Exemplary embodiments of the present invention will be described in detail based on the following figures, wherein.

DETAILED DESCRIPTION

Physical Properties of Display Medium

Figure 1:
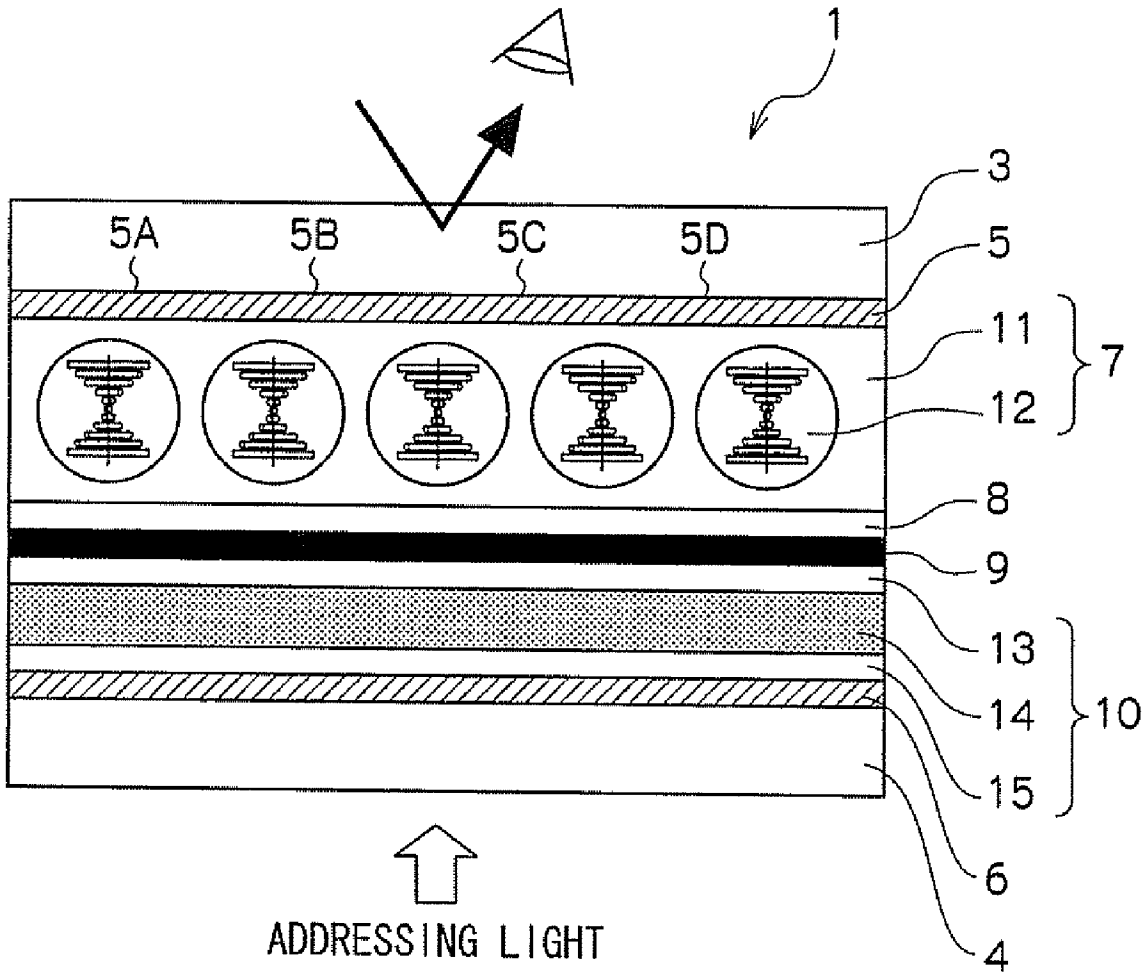
FIG. 1 is a cross-section of a display medium.

FIG. 1 shows a cross-section of an optically written display medium 1 of the present exemplary embodiment. The display medium 1 is a display medium capable of recording an image by irradiation with an addressing light according to the image together with application of a bias signal (voltage).

As shown in FIG. 1, the display device 1 includes a transparent substrate 3, a transparent electrode 5 configured with electrodes 5A, 5B, 5C and 5D, a display layer (liquid crystal layer) 7, a laminate layer 8, a colored layer (light shielding layer) 9, a photoconductor layer 10, a transparent electrode 6 and a transparent substrate 4, disposed in this order from the display surface side.

The transparent substrates 3 and 4 are substrates that hold each of the functional layers on their internal faces to maintain the structure of the display medium. The transparent substrates 3 and 4 are each configured from a sheet form member having sufficient strength to be capable of withstanding an external force. The substrate 3 on the display surface side transmits at least incident light, and the substrate 4 on the writing surface side transmits at least addressing light.

The substrates 3 and 4 are preferably flexible. Specific examples of the material of the substrates include an inorganic sheet (such as glass or silicon), and a polymer film (such as polyethylene terephthalate, polysulfone, polyether sulfone, polycarbonate and polyethylene naphthalate). The substrates may be configured with a known functional film formed on the outer surface thereof, such as an anti-fouling film, an abrasion resistant film, an anti-reflection film or a gas barrier film.

It should be noted that the transparent substrates 3 and 4 in the present exemplary embodiment are transparent across the entire spectrum of visible light, however substrates that are only transparent to light in the display wavelength region may also be used.

The transparent electrodes 5 and 6 are electrodes for applying a bias voltage from an optical recording device 2 to each of the functional layers within the display medium 1. In the present exemplary embodiment, the transparent electrode 5 is configured, as an example, with the four electrodes 5A, 5B, 5C and 5D all of substantially the same shape (for example a rectangular shape), and the transparent electrode 6 is configured by a single transparent electrode of surface area substantially equivalent to that of the whole of the display medium 1 (see FIG. 2). It should be noted that while in this embodiment the transparent electrode 5 on the display surface side is divided, a configuration may be made with the transparent electrode 6 on the writing surface side divided.

The transparent electrodes 5 and 6 have uniform inplane (electro)conductivity. The transparent electrode 5 on the display surface side transmits at least incident light, and the transparent electrode 6 on the writing surface side transmits at least addressing light. Specific examples thereof include electroconductive thin films formed of a metal (such as gold or aluminum), a metallic oxide (such as indium oxide, tin oxide or indium tin oxide (ITO)), and electroconductive organic polymers (such as a polythiophene based polymer or a polyaniline based polymer). The surfaces thereof may have a known functional film, such as an adhesiveness improving film, an anti-reflection film and a gas barrier film formed thereon.

It should be noted that the transparent substrates 5 and 6 in the present exemplary embodiment are transparent across the entire spectrum of visible light, however substrates that are only transparent to light in the display wavelength region may also be used.

The display layer 7 functions such that the reflection or transmission state to light having a specific color from incident light is modulated by an electric field, and the display layer 7 has the property of being able to maintain the selected state without an electric field. The display layer 7 preferably has a structure able to withstand deformation due to an external force, such as bending or pressure.

In the present invention, as an example, the display layer 7 is a liquid crystal layer of a self-supported liquid crystal composite formed from a cholesteric liquid crystal and a transparent resin. In other words, the composite is a self-supporting liquid crystal layer not requiring spacers or the like, however, there is no limitation thereto. In this exemplary embodiment, a cholesteric liquid crystal 12 is in a dispersed state in a polymer matrix (transparent resin) 11, as shown in FIG. 1.

Cholesteric Liquid Crystal Composition

The cholesteric liquid crystal 12 functions so as to modulate the reflection or transmission state to light having a specific color from incident light, and the liquid crystal molecules are oriented in a twisting helical form, so as to interfere with and reflect specific light depending on the helical pitch from light incident in the direction of the helical axis. The orientation of the molecules is chanced with an electric field, enabling the reflection state to be changed. The drop size is preferably uniform and the drops are preferably disposed closely packed to form a single layer.

Examples of specific liquid crystals that can be used as the cholesteric liquid crystal 12 include: nematic liquid crystals and smectic liquid crystals (such as a Schiff base-, azo-, azoxy-, benzoate ester-, biphenyl-, terphenyl-, cyclohexylcarboxylate ester-, phenylcyclohexane-, biphenylcyclohexane-, pyrimidine-, dioxane-, cyclohexylcyclohexane ester-, cyclohexylethane-, cyclohexane-, tolan-, alkenyl-, stilbene-, and condensed polycyclic-liquid crystals), and mixtures thereof with a chiral agent (such as a steroid cholesterol derivative-, Schiff base-, azo-, ester-, or biphenyl-agent) added thereto.

The helical pitch of the cholesteric liquid crystal is adjusted using the addition amount of the chiral agent with respect to the nematic liquid crystal. For example, when the display colors are blue, green and red, the center wavelengths of selective reflection are in the ranges of from 400 to 500 nm, from 500 to 600 nm and from 600 to 700 nm, respectively. Known measures may be employed in order to compensate for the temperature dependency of the helical pitch of the cholesteric liquid crystal, such as adding plural chiral agents having different directions of twist or having opposite temperature dependencies.

Examples of the display layer 7 with self-supporting liquid crystal composite formed from the cholesteric liquid crystal 12 and the polymer matrix (transparent resin) 11 include a PNLC (Polymer Network Liquid Crystal) structure containing a network resin in a continuous phase of cholesteric liquid crystal, or a PDLC (Polymer Dispersed Liquid Crystal) structure containing cholesteric liquid crystal dispersed as droplets in a polymer skeleton (including microencapsulated structures). By using a PNLC structure or a PDLC structure an anchoring effect occurs at the interface between the cholesteric liquid crystal and the polymer, enabling further stabilization of the maintenance state of planar texture or focal conic texture without an electric field.

PNLC structures and PDLC structures can be formed by known methods such as: PIPS (Polymerization Induced Phase Separation) methods, in which a polymer precursor polymerizable with heat, light, an electron beam or the like, such as an acrylic-, a thiol- or an epoxy-polymer precursor, is mixed with a liquid crystal, and the resulting uniform phase is polymerized to induce phase separation; emulsion methods, in which a polymer having a low solubility to a liquid crystal, such as polyvinyl alcohol, is mixed with the liquid crystal, and agitated to disperse droplets of the liquid crystal suspended in the polymer; TIPS (thermally Induced Phase Separation) methods, in which a thermoplastic polymer and a liquid crystal are mixed and heated to obtain a uniform phase, which is then cooled to induce phase separation; and SIPS (solvent induced phase separation) methods, in which a polymer and a liquid crystal are dissolved in a solvent, such as chloroform, and the solvent is evaporated to induce phase separation of the polymer and the liquid crystal. However, the invention is not particularly limited in the method used.

Polymer Matrix 11

The polymer matrix 11 functions so as to support the cholesteric liquid crystal 12, suppressing flowing of the liquid crystal (change of an image) due to deformation of the display medium. Preferred examples thereof include polymer materials that do not dissolve in the liquid crystal material and do dissolve in a solvent that is not compatible with the liquid crystal. The polymer matrix 11 is preferably strong enough to withstand external forces and preferably exhibits high transparency at least to the reflection light and the addressing light.

Examples of materials that can be used as the polymer matrix 11 include water soluble polymer materials (such as gelatin, a polyvinyl alcohol, a cellulose derivative, a polyacrylic acid polymer, ethylene imine, polyethylene oxide, polyacrylamide, a polystyrene sulfonate salt, polyamidine or an isoprene sulfonic acid polymer), and materials capable of forming an aqueous emulsion (such as a fluorine resin, a silicone resin, an acrylic resin, a urethane resin or an epoxy resin).

Photoconductor Layer 10

The photoconductor layer 10 is a layer that has an internal photoelectric effect and changes in impedance characteristics according to the radiation intensity of the addressing light. The photoconductor layer 10 is preferably drivable with an alternating current, with symmetrical driving with respect to the addressing light. The photoconductor layer 10 preferably has a three-layer structure containing a charge transporting layer (CTL) with charge generating layers (CGL) disposed above and below. In this embodiment, as an example, the photoconductor layer 10 has an upper charge generating layer 13, a charge transporting layer 14 and a lower charge generating layer 15 disposed from the upper side in FIG. 1.

Charge Generating Layers 13 and 15

The charge generating layers 13 (upper CGL) and 15 (lower CGL) function to absorb addressing light and generate photo carriers. The charge generating layer 13 mainly determines the amount of photo carriers flowing from the transparent electrode 5 on the display surface side to the transparent electrode 6 on the writing surface side, and the charge generating layer 15 mainly controls the amount of photo carriers flowing from the transparent electrode 6 on the writing surface side to the transparent electrode 5 on the display surface side. The charge generating layers 13 and 15 preferably layers that generate excitons, through absorption of addressing light, which efficiently separate into free carriers within the charge generating layer or at the interface between the charge generating layer and the charge transporting layer.

The charge generating layers 13 and 15 can be formed, for example, by a dry method, in which a charge generating material is directly formed into a layer, or a wet coating method, in which a charge generating material is dispersed or dissolved in a suitable solvent along with a polymer binder to prepare a coating liquid, which is then coated and dried to form the layer. Examples of such charge generating materials include a metallic or non-metallic phthalocyanine, a squalirium compound, an azulenium compound, a perylene pigment, an indigo pigment, a bis- or tris-azo pigment, a quinacridone pigment, a pyrrolopyrol colorant, a polycyclic quinone pigment, a condensed aromatic pigment such as dibromoanthanthrone, a cyanine colorant, a xanthene pigment, a charge transfer complex such as polyvinylcarbazole or nitrofluorene, or an eutectic complex formed of a pyrylium salt dye and a polycarbonate resin. Examples of the polymer binder include a polyvinyl butyral resin, a polyarylate resin, a polyester resin, a phenol resin, a vinylcarbazole resin, a vinyl formal resin, a partially modified vinylacetal resin, a carbonate resin, an acrylic resin, a vinyl chloride resin, a styrene resin, a vinyl acetate resin or a silicone resin.

Charge Transporting Layer 14

The charge transporting layer 14 is a layer that functions such that the photocarriers generated in the charge generating layers 13 and 15 are injected into the charge transporting layer 14 and drift in the direction of an electric field applied with the bias signal. In general, the charge transporting layer has a thickness that is several tens of times the thickness of the charge generating layer, and therefore, the contrast impedance of the photoconductor layer 10 as a whole is determined by the capacity of the charge transporting layer 14, the dark current of the charge transporting layer 14 and the photo carrier current within the charge transporting layer 14.

The charge transporting layer 14 is preferably a layer that is injected with free carriers from the charge generating layers 13 and 15 with high efficiency (the charge transporting layer 14 preferably has an ionization potential close to those of the charge generating layers 13 and 15), and is preferably a layer in which the free carriers thus injected undergo hopping migration at as high a rate as possible. In order to increase the dark impedance, the charge transporting layer 14 is preferably a layer in which the dark current from thermal carriers is low.

The charge transporting layer 14 may be formed with a low molecular weight hole transporting material, or a low molecular weight electron transporting material, dispersed or dissolved in a suitable solvent along with a polymer binder to prepare a coating composition, or alternatively the hole transporting material or the electron transporting material may be formed into a polymer, which is then prepared by dispersing or dissolving in a suitable solvent, followed by coating and drying. Examples of such low molecular weight hole transporting materials include a trinitrofluorene compound, a polyvinylcarbazole compound, an oxadiazole compound, a hydrazone compound such as benzylamino hydrazone or quinoline hydrazone, a stilbene compound, a triphenylamine compound, a triphenylmethane compound or a benzidine compound. Examples of such low molecular weight electron transporting materials include a quinone compound, a tetracyanoquinodimethane compound, a fluorenone compound, a xanthone compound or a benzophenone compound. Examples of the polymer binder include a polycarbonate resin, a polyarylate resin, a polyester resin, a polyimide resin, a polyamide resin, a polystyrene resin or a silicon-containing crosslinked resin.

Colored Layer 9

The colored layer (light shielding layer) 9 is not an essential constitutional element of the present exemplary embodiment, and is provided in order that addressing light and writing light are optically separated during writing to prevent malfunction due to mutual interference, and in order that during display external light incident from the non-display surface side of the display medium and the displayed image are optically separated during display to prevent deterioration of the image. However, the colored layer is preferably provided in order to improve the performance of the display medium 1. Due to its purpose the colored layer 9 is required to function to absorb at least light at the absorption wavelength region of the charge generating layer and to absorb light at the reflection wavelength region of the display layer.

The colored layer 9 may be formed, for example, by a dry method, in which an inorganic pigment, an organic dye or an organic pigment is directly formed into a layer on the surface charge generating layer 13 side of the photoconductor layer 10, or a wet coating method, in which the pigment or dye is dispersed or dissolved in a suitable solvent along with a polymer binder to prepare a coating liquid, which is then coated and dried to form the layer Examples of such inorganic pigments include cadmium-, chromium-, cobalt-, manganese- or carbon-pigments. Examples of such organic dyes and organic pigments include azo-, anthraquinone-, indigo-, triphenylmethane-, nitro-, phthalocyanine-, perylene-, pyrrolopyrol-, quinacridone-, polycyclic quinone-, squalirium-, azulenium-, cyanine-, pyrylium- or anthrone-dyes and pigments. Examples of such polymer binders include polyvinyl alcohol resins or polyacrylic resins.

Laminate Layer 8

The laminate layer 8 is not an essential constitutional element of the exemplary embodiment and is provided to absorb unevenness and to provide bonding when adhering together the respective functional layers provided on the inner surfaces of the upper and lower substrates. The laminate layer 8 may be formed of a polymer material having a low glass transition temperature, selected from such materials that are capable of adhering the display layer 7 and the colored layer 9 by application of heat or pressure. The laminate layer 8 should have transmissivity at least to incident light.

Examples of materials suitable for the laminate layer 8 include adhesive polymer materials (such as urethane resins, epoxy resins, acrylic resins and silicone resins).

Display Medium Equivalent Circuit

Figure 3:
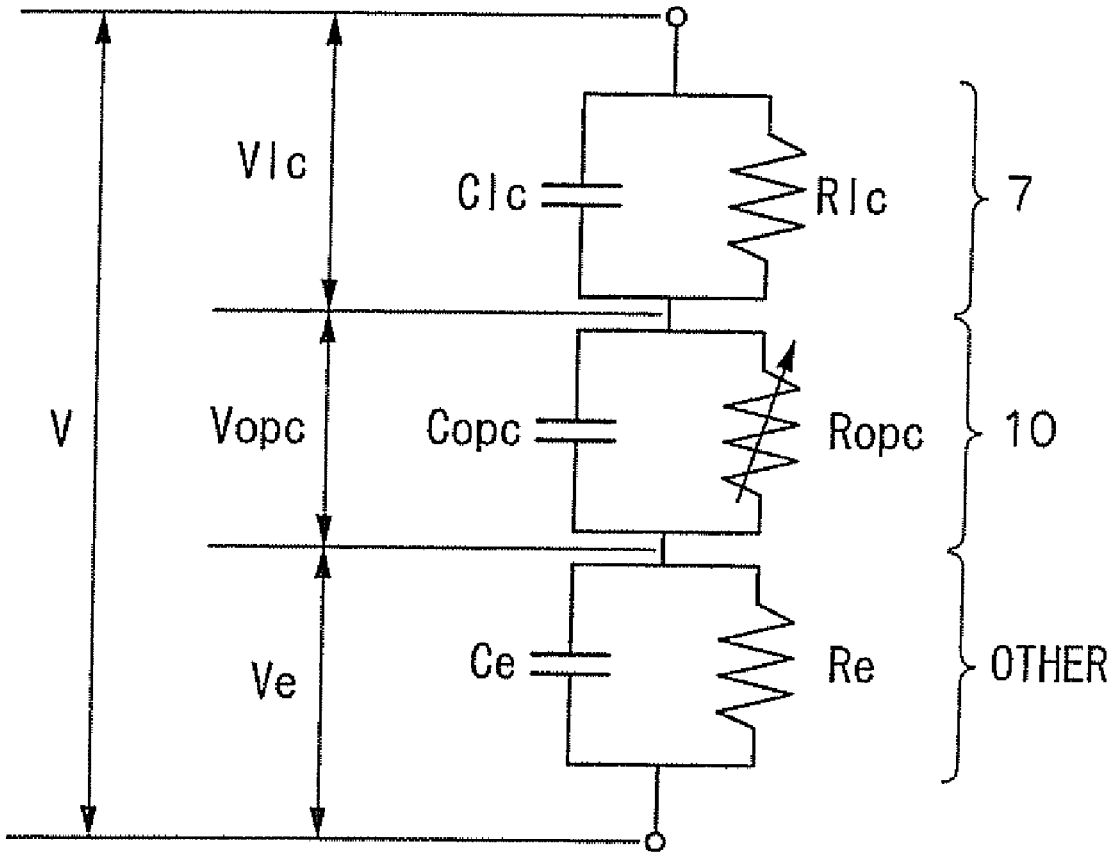
FIG. 3 is a circuit diagram showing an equivalent circuit of a display medium.

FIG. 3 is a circuit diagram showing an equivalent circuit of the display medium (liquid crystal device) 1 having the structure shown in FIG. 1. Clc and Rlc represent the values of the electrostatic capacity and the resistance of the display layer 7, and Copc and Ropc represent the values of the electrostatic capacity and the resistance of the photoconductor layer 10. Ce and Re represent the values of the equivalent electrostatic capacity and the equivalent resistance of the other elements in the configuration other than the display layer 7 and the photoconductor layer 10.

When a voltage V is applied between the transparent electrode 5 and transparent electrode 6 of the display medium 1 from the external optical writing device 2, partial voltages Vlc, Vopc and Ve are applied across each of the constitutional elements, according to the impedance ratios between the constitutional elements. More specifically, partial voltages determined by the capacity ratio of the constitutional elements are generated immediately after applying a voltage, and the partial voltages relax with time to partial voltages determined by the resistance ratio of each of the constitutional elements.

Since the resistance Ropc of the photoconductor layer 10 changes according to the intensity of the addressing light, the effective voltage applied to the display layer 7 can be controlled by light exposure or non exposure. The resistance Ropc of the photoconductor layer 10 is lowered during exposing, increasing the effective voltage applied to the display layer 7, and in contrast the resistance Ropc of the photoconductor layer 10 is increased during non exposure, decreasing the effective voltage applied to the display layer 7.

Cholesteric Liquid Crystal Orientation Properties

Specific explanation will now be given regarding the cholesteric liquid crystal (chiral nematic liquid crystal) 12. A planar texture exhibited by the cholesteric liquid crystal 12 separates incident light parallel to the helical axis into dextrorotatory light and levorotatory light, and causes a selective reflection phenomenon to occur in which a circularly polarized component agreeing with the twist direction of the helix is reflected by Bragg reflection, and the remaining light is transmitted. The center wavelength $\lambda$ and the reflected wavelength range $\Delta\lambda$ are expressed by the following equations: $\lambda=n*p$, and $\Delta\lambda=\Delta n*p$, wherein p represents the helix pitch, n represents the average refractive index within the plane perpendicular to the helical axis, and $\Delta n$ represents the birefringence within that plane. The light reflected by the cholesteric liquid crystal layer having a planar texture exhibits a bright color that depends on the helix pitch.

Figure 4A:
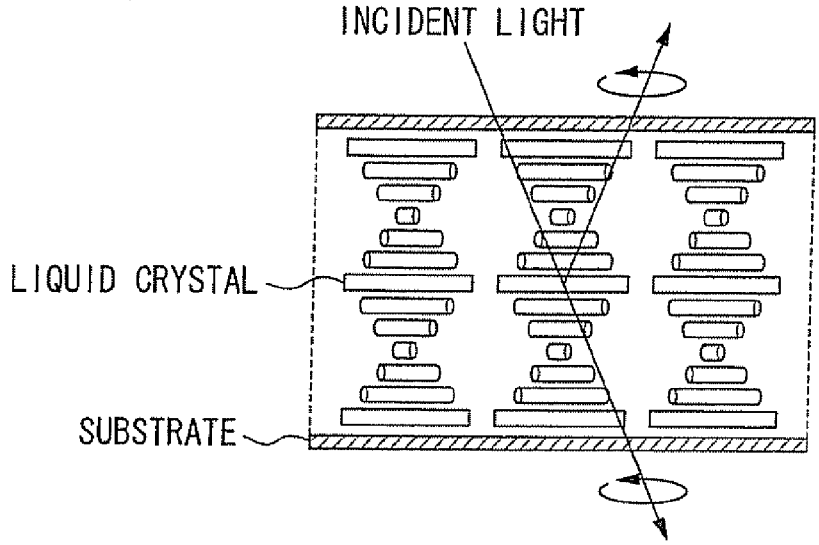
FIG. 4A is an explanatory model diagram showing the relationship between molecular orientation and optical properties of a cholesteric liquid crystal in a planar texture.
Figure 4B:
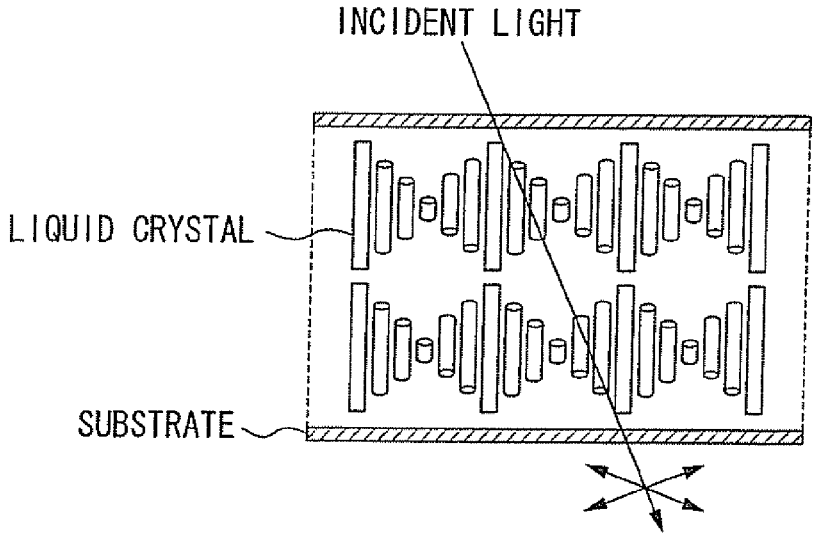
FIG. 4B is an explanatory model diagram showing the relationship between molecular orientation and optical properties of a cholesteric liquid crystal in a focal conic texture.
Figure 4C:
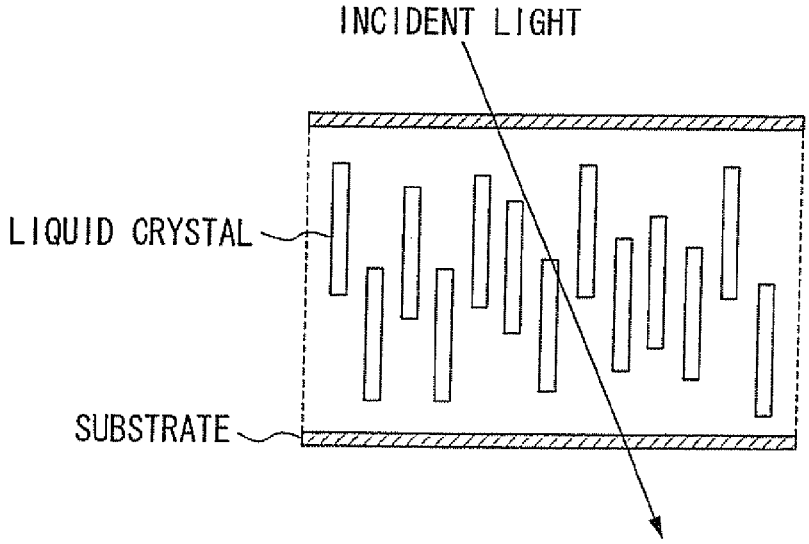
FIG. 4C is an explanatory model diagram showing the relationship between molecular orientation and optical properties of a cholesteric liquid crystal in a homeotropic texture.

A cholesteric liquid crystal having a positive dielectric anisotropy exhibits the following three states. In a planar texture (P texture), the helical axis is perpendicular to the cell surface as shown in FIG. 4A, and incident light is subjected to the selective reflection phenomenon described above. In a focal conic texture (F texture), the helical axis is substantially parallel to the cell surface as shown in FIG. 4B, and incident light is transmitted with slightly forward scattering. In a homeotropic texture (H texture), the helical structure is unraveled and the liquid crystal director is orientated in the electric field direction as shown in FIG. 4C, and substantially all incident light is transmitted.

Among the above three states, the planar texture and the focal conic texture are capable of exhibiting bistability without an electric field. Therefore, the phase state of a cholesteric liquid crystal is not determined uniformly by the intensity of the electric field applied to the liquid crystal layer, and when the initial state is a planar texture, the phase state is changed sequentially from a planar texture to a focal conic texture and then a homeotropic texture, in this order, as the intensity of the electric field increases. When the initial state is a focal conic texture the phase state is changed sequentially from a focal conic texture to a homeotropic texture in this order as the intensity of the electric field increases.

However, when the intensity of the electric field applied to the liquid crystal layer is decreased suddenly to zero, the planar texture and the focal conic texture maintain their states, and the homeotropic texture chances to a planar texture.

Figure 5:
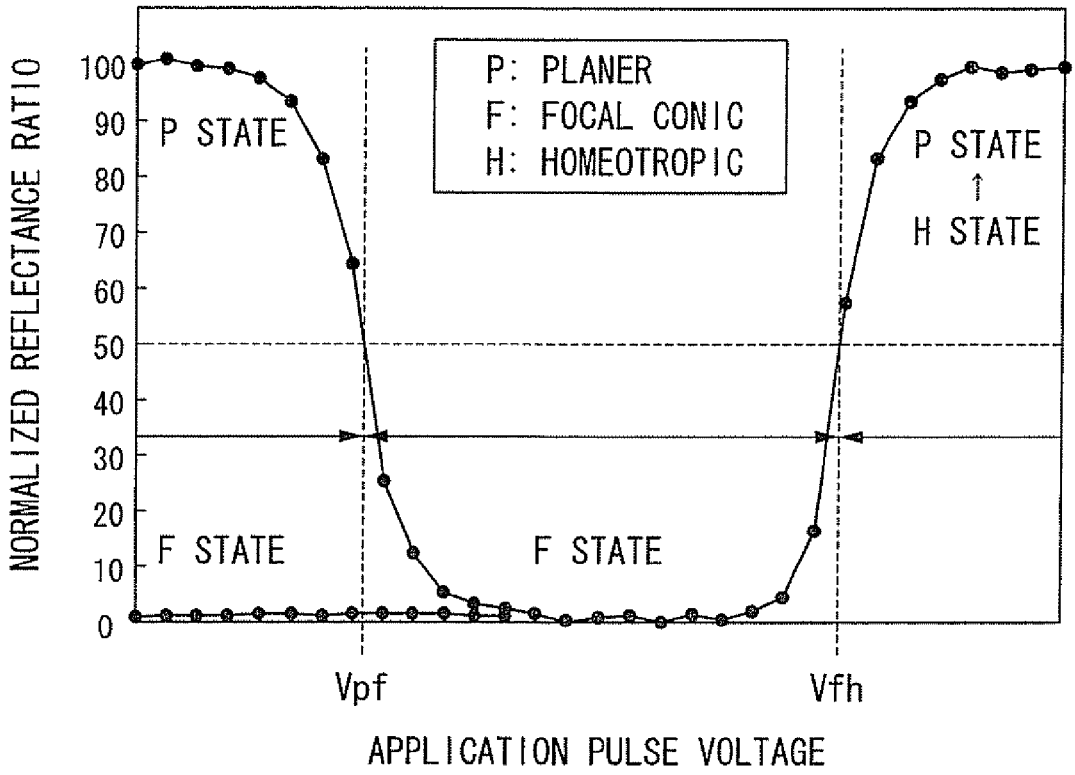
FIG. 5 is a graph for explaining the switching behavior of a cholesteric liquid crystal.

Consequently, the cholesteric liquid crystal layer shows switching behavior as shown in FIG. 5 immediately after being applied with a pulse signal. That is, when the voltage of the pulse signal applied is Vfh or higher, a selective reflection state occurs where homeotropic texture is chanced to planar texture. When the voltage is between Vpf and Vfh, a transmission state occurs with a focal conic texture. When the voltage is Vpf or lower, the state before applying the pulse signal continues, namely continues as a selective reflection state with a planar texture or as a transmission state with a focal conic texture.

In FIG. 5, the vertical axis shows the normalized reflectivity, which is obtained by normalizing the reflectivity with the maximum reflectivity as 100 and the minimum reflectivity as 0. Transition states appear between the planar texture, the focal conic texture and the homeotropic texture, and therefore, it is determined that when the normalized reflectivity is 50 or more this is designated as the selective reflection state, when the normalized reflectivity is less than 50 this is designated as the transmission state, the value of the threshold voltage of phase transition from the planar texture to the focal conic texture is designated as Vph, and the value of the threshold voltage of phase transition from the focal conic texture to the homeotropic texture is designated as Vfh.

In particular, in a PNLC (Polymer Network Liquid Crystal) structure containing a network resin in a continuous phase of a cholesteric liquid crystal, and in a PDLC (Polymer Dispersed Liquid Crystal) structure containing a cholesteric liquid crystal dispersed as droplets in a polymer skeleton (including microencapsulated structures), the bistability of the planar texture and of the focal conic texture is raised when there is no electric field, due to interference at the interface between the cholesteric liquid crystal and the polymer (an anchoring effect), whereby the state immediately after applying a pulse signal is maintainable for a long period of time.

In the display medium 1 using such a cholesteric liquid crystal 12, a selective reflection state (A) with a planar texture and a transmission state with a focal conic texture (B) are switched between by utilizing the bistability phenomenon of the cholesteric liquid crystal, so as to realize a black/white monochrome display having a memory effect with no electric field, or a color display having a memory effect with no electric field.

When the initial state of the cholesteric liquid crystal 12 is in the plane texture state (P texture state) or the homeotropic texture state (H texture state) the state changes to the P state, to the focal conic texture state (F texture state), or to the H texture state according to the size of the external voltage. When the initial state is in the F texture state the state chances to the F texture state or to the H texture state according to the size of the external voltage. If the final state is in the P texture state or the F texture state then these respective states are maintained after stopping applying voltage, however, when the final state is the H texture state, then the state changes to the P texture state. Consequently the P texture state and the F texture state are selectable for the final state according to the size of the applied voltage, independent of whether there is exposure or no exposure. As shown in FIG. 5, the P texture state is the refection state and the F texture state is the transmission state.

Optical Writing Image Forming Device Configuration

Explanation will now be given of an optical writing image forming device 20.

Figure 2:
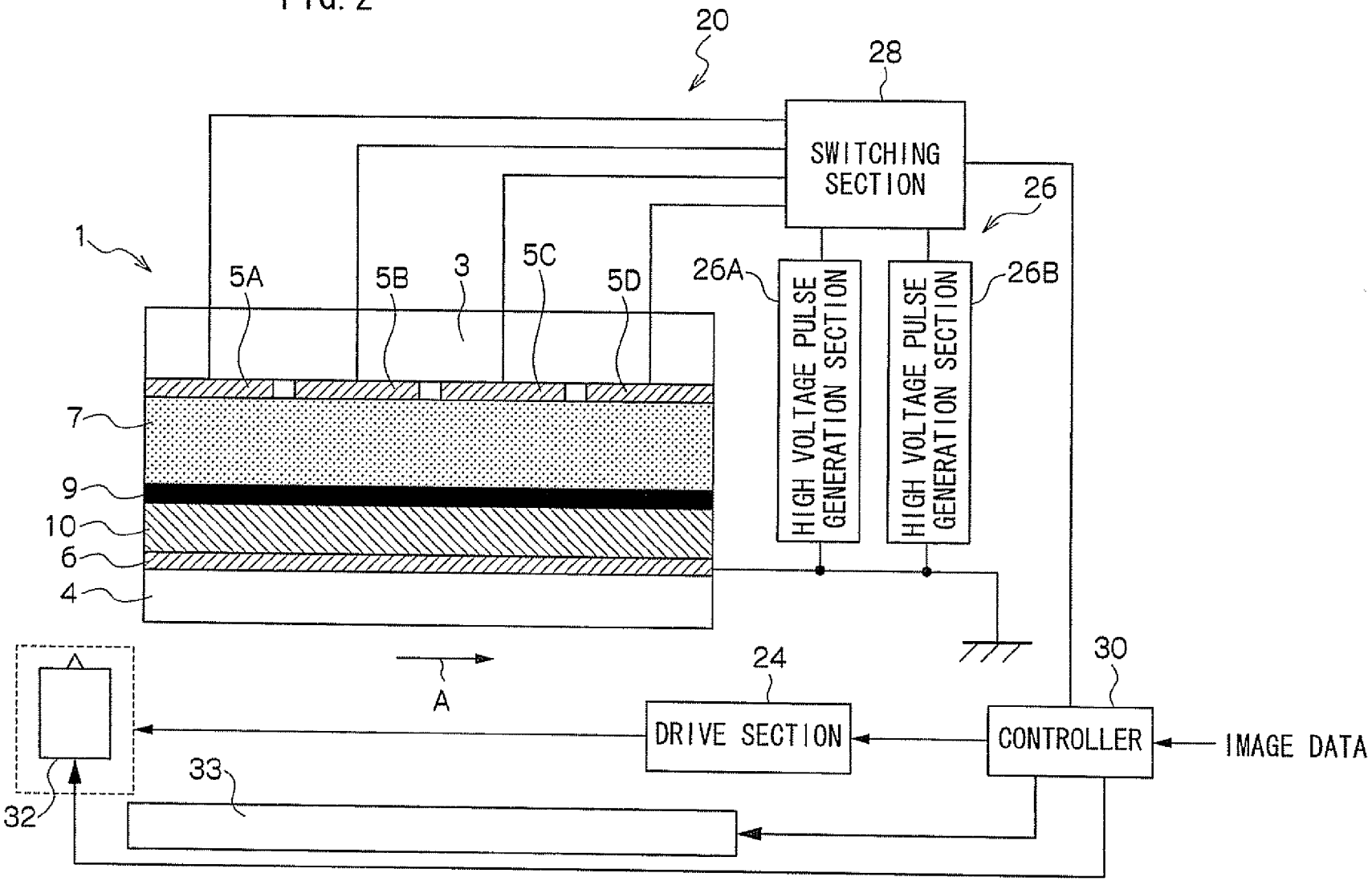
FIG. 2 is a schematic diagram of an image display device.

The optical writing image forming device 20 is, as shown in FIG. 2, a device for displaying an image on the display medium 1 by irradiating light. The optical writing image forming device 20 is configured with: an image writing light source section 32 that carries out irradiation of addressing light onto the display medium 1; a drive section 24 that moves the image writing light source section 32 in the direction of arrow A of FIG. 2 so that the image writing light source section 32 moves relative to the display medium 1; a reset light source section 33 that is disposed on the opposite side of the image writing light source section 32 to that of the display medium 1; a voltage application section 26 formed from high voltage pulse generation sections 26A and 26B that generate a bias voltage (high voltage pulse) for application to the display medium 1; a switching section 28 that switches application of the bias voltages generated by the high voltage pulse generation sections 26A and 26B to the electrodes; and a controller 30 that controls the 24 and the switching section 28.

The image writing light source section 32 irradiates the display medium 1 (or more precisely onto the photoconductor layer 10) with an addressing light pattern (optical image pattern) based on a signal input from the controller 30 according to the image.

The reset light source section 33 is configured in a planar shape that faces the display surface of the display medium 1, with a light generation face thereof facing the display medium 1, and the reset light source section 33 resets the display medium 1.

The resetting (initialization) of the display medium 1 is, for example, initialization of the orientation of crystals in the cholesteric liquid crystal 12, so as, for example, to form a uniform F texture state or uniform P texture state. In the present exemplary embodiment the initial state is the P texture state (state with high reflectance).

Addressing light emitted by the image writing light source section 32 is desirably light with a strong peak in the absorption wavelength region of the photoconductor layer 10, with a frequency band that is as narrow as possible.

Examples of devices applicable for the image writing light source section 32 and reset light source section 33 include cold-cathode tubes, xenon lamps, halogen lamps, light emitting diodes (LED), EL elements, or lasers disposed in a one-dimensional array or combined with a polygonal mirror. The image writing light source section 32 is one capable of forming a desired two-dimensional light emitting pattern through a scanning motion. The reset light source section 33, for example, uses a light source capable of irradiating uniform light in a plane shape of substantially the same surface area as the display medium 1, such as one of the above light sources disposed in a matrix shape (in rows and columns) or combined with a light guide plate.

The high voltage pulse generation section 26A is a circuit for generating a reset voltage and the high voltage pulse generation section 26B is a circuit for generating both a reset voltage and an image writing voltage. High voltage amps that generate opposite polarity voltages are, for example, used in the high voltage pulse generation sections 26A and 26B respectively.

In the present exemplary embodiment, as shown in FIG. 2, the high voltage pulse generation section 26A that is grounded to the transparent electrode 6 of the display medium 1 outputs a DC voltage of positive polarity, and the high voltage pulse generation section 26B applies a DC voltage of negative polarity. An AC voltage can be supplied by combination thereof.

The reset voltage applied for the electrodes 5A, 5B, 5C and 5D to the grounded transparent electrode 6 is an AC voltage with positive polarity and negative polarity (a combination of a DC voltage of positive polarity and a DC voltage of negative polarity).

The image writing voltage applied for the electrodes 5A, 5B, 5C and 5D to the grounded transparent electrode 6 is a DC voltage of positive polarity.

Reset Light Irradiation

The voltage value of the reset voltage when the reset voltage has been applied between the transparent electrodes is a voltage value capable of resetting (initializing) the display medium 1. Specifically, for example, the voltage value is set to be a value capable of initializing the orientation of the crystals of the cholesteric liquid crystal 12 (in the present exemplary embodiment this is a uniform F texture state as the first reset action). If the first reset action is initialization to the F texture state then, as shown in FIG. 5, the voltage value is set such that the voltage (partial voltage) applied to the display layer 7 is a voltage in the range that is higher than Vpf but lower than Vfh.

In the present exemplary embodiment, as a second reset action, the reset light is emitted on the display medium 1 by the reset light source section 33 only for the period of time when the DC voltage of positive polarity is being applied in the above described reset voltage. In other words, when a DC voltage of negative polarity is being applied there is no irradiation of the display medium 1 by the reset light source section 33.

Figure 6A:
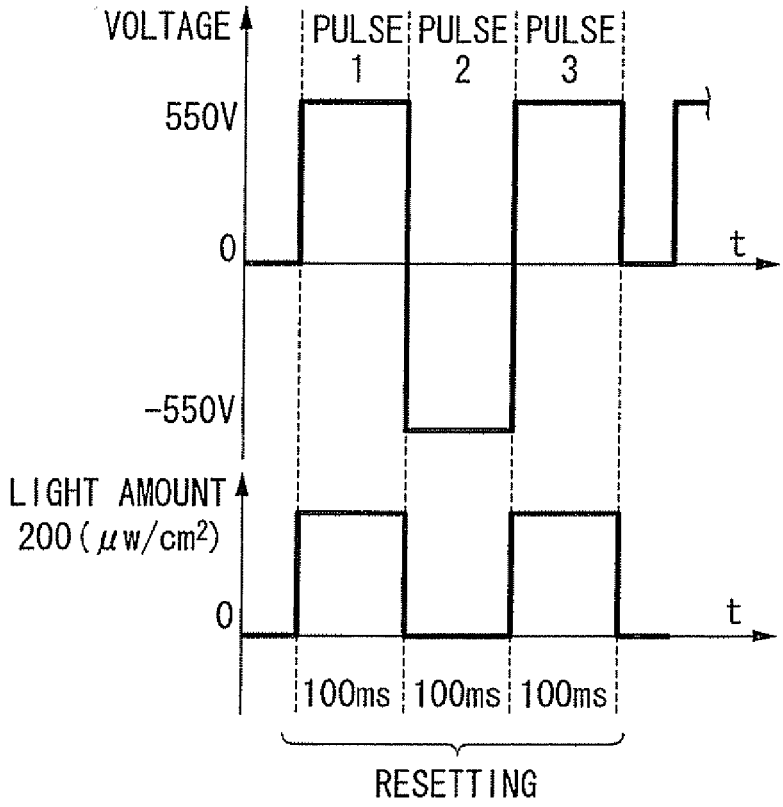
FIG. 6A is a timing chart showing a pattern of voltage application and resetting irradiation during initialization pertaining to a reset light irradiation procedure 1.

As a first example, as shown in FIG. 6A, there is a pattern of reset voltage application order of positive polarity voltage, negative polarity voltage application, and positive polarity voltage application (reset light irradiation procedure 1). The reset light irradiation procedure 1, as shown in FIG. 6A, synchronizes irradiation of reset light with the initial positive polarity voltage application period and the final positive polarity voltage application period. It should be noted that such a pattern may be repeated plural times.

Figure 8A:
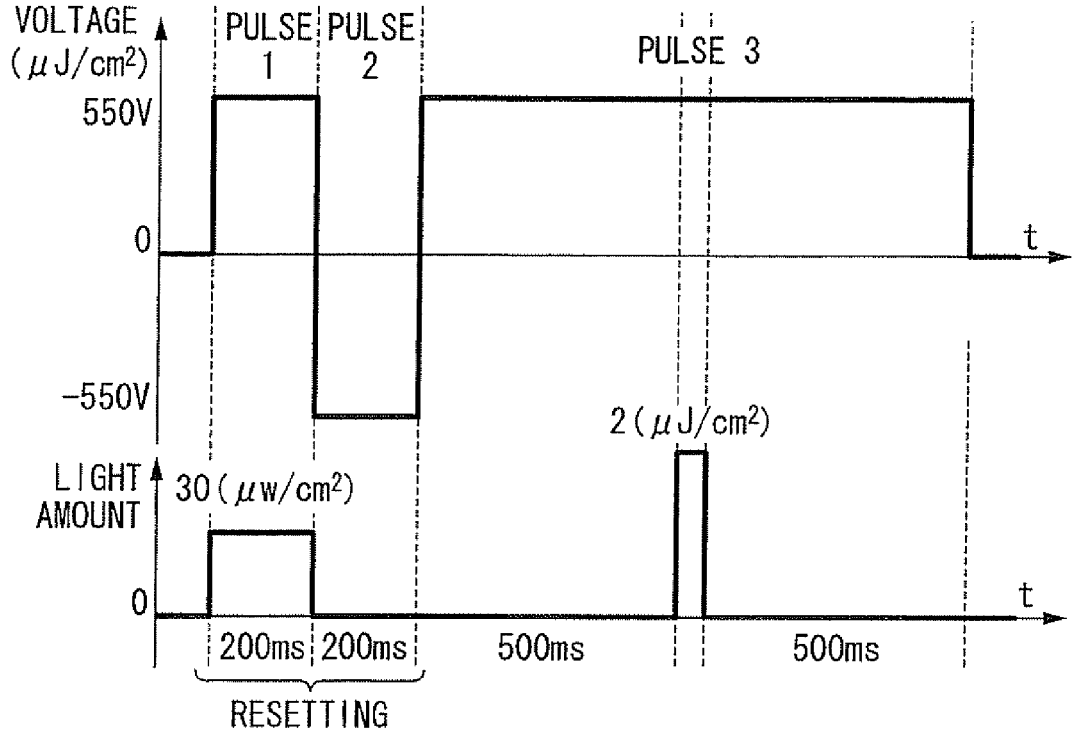
FIG. 8A is a timing chart showing a pattern of voltage application and resetting irradiation during initialization pertaining to a reset light irradiation procedure 2.

Next, as a second example, as shown in FIG. 8A, there is a pattern of reset voltage application order of positive polarity voltage, negative polarity voltage application (reset light irradiation procedure 2). The reset light irradiation procedure 2, as shown in FIG. 8A, synchronizes irradiation of reset light with the initial positive polarity voltage application period. It should be noted that such a pattern may be repeated plural times.

In this reset light irradiation procedure 2 when combined with the voltage application (positive polarity voltage) during the image writing period the pattern becomes an order of positive polarity voltage application, negative polarity voltage application, and positive polarity voltage application, switching between alternate polarities.

Principle of Non-Irradiation During Negative Polarity Voltage Application

By irradiating the reset light by either the above reset light irradiation procedure 1 or reset light irradiation procedure 2 the partial resistance becomes low and the voltage value for resetting becomes high (becoming a voltage in excess of the voltage Vfh shown in FIG. 5). As a result, the display medium 1 exhibits a uniform P texture state.

When irradiating light during a negative polarity voltage application, positive charge generated in the upper CGL 13 transitions through the CTL 14 toward the lower CGL 15, and gradually negative charge that is counter charge for the positive charge accumulates in the vicinity of the CGL.

When light is emitted during both polarities of voltage application, there are no problems initially, but when successive repetitions of driving (optical writing) is undertaken is a gradual deterioration in the display characteristics (the reflectivity decreases).

By making the level of photosensitivity of the upper CGL 13 and the lower CGL 15 symmetrical, the initial charge amounts can be made substantially symmetrical and superior functionality is exhibited, however it is necessary to prevent accumulation of charge in order to further improve the maintainability.

With respect to this, by irradiating reset light only during positive polarity voltage application (or in other words by not irradiating reset light during negative polarity voltage application), a balance is obtained between generation and dissipation of the electric field, and there is therefore an improvement in reducing the deterioration of display characteristics when driving is repeated successively.

Image Writing

The voltage value of the voltage used for image writing is set to at least a voltage value capable of recording an image on the display medium 1 when the image writing voltage is applied between the transparent electrodes in a state in which the image writing light source section 32 irradiates the display medium 1 with image light according to the image. For example, if image writing is performed by changing the orientation of the liquid crystal of the cholesteric liquid crystal 12 from the P texture state to the F texture state then the voltage (partial voltage) applied to the display layer 7 in positions irradiated with the image light, is a voltage value within the range of voltages greater than Vpf but lower than Vfh.

According to instructions from the controller 30, the switching section 28: selectively switches the electrode for applying the reset voltage and the electrode for applying the image writing voltage; applies the reset voltages output from the high voltage pulse generation sections 26A and 26B to the electrode selected for reset voltage application; and applies the image writing voltage output from the high voltage pulse generation section 26B to the electrode selected for application of the image writing voltage.

The drive section 24 moves the image writing light source section 32 in the direction of arrow A shown in FIG. 2 (secondary scanning direction) according to instructions from the controller 30. The drive section 24 is, for example, configured from a pulse motor or the like, and the image writing light source section 32 is moved in the direction of arrow A of FIG. 2 by drive from the pulse motor.

The controller 30: instructs the drive section 24 so as to move the image writing light source section 32 at a specific speed in the direction of arrow A shown in FIG. 2; controls each light source so that, based on input image data, reset light is emitted on the display medium 1 by a reset light source 33 at a later described timing and also so that, based on input image data, image light is emitted on the display medium 1 by the image writing light source section 32; and controls the switching section 28 such that reset voltage and image writing voltage are applied to each of the electrodes 5A, 5B, 5C and 5D at later described timings.

Resetting During Image Writing

Figure 11:
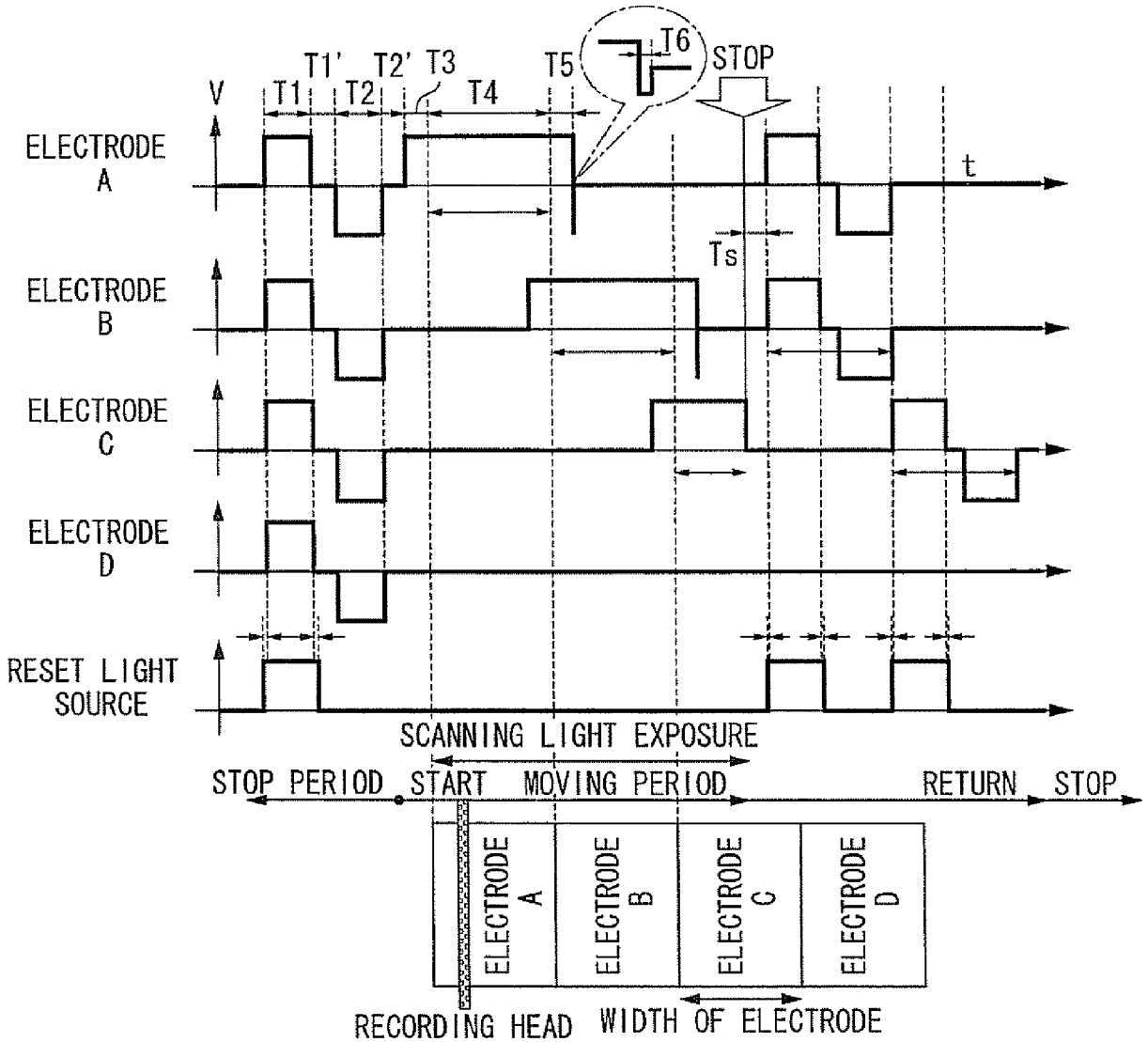
FIG. 11 is timing chart pertaining to a reset procedure during image writing 1.
Figure 13:
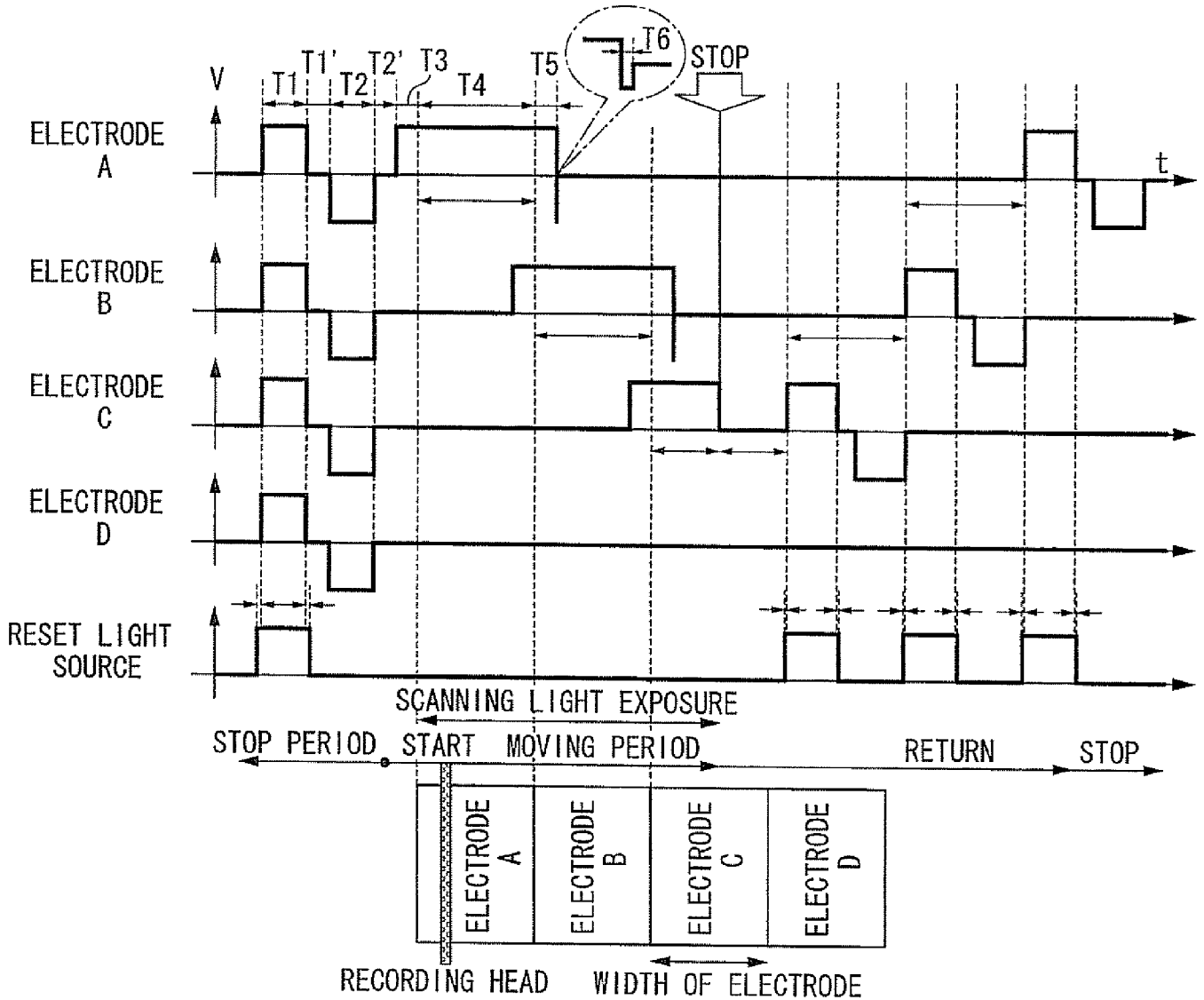
FIG. 13 is timing chart pertaining to a reset procedure during image writing 3.

There are occasions when an instruction is given to stop writing during image writing (in FIGS. 11 and 13 when the image writing light source section 32 corresponds to electrode 5C). When such an instruction to stop the writing being carried out is given, the fact that the image writing light source section 32 is positioned at the electrode 5C means that there is at least an image displayed on the display surface corresponding to the electrodes on the upstream side (electrodes 5A and 5B in this case).

One event that might arise in which instruction is given to stop ongoing writing when rapid erasure of a displayed (instructed to be displayed) image is required. However, writing with the image writing light source section 32 obstructs (casts a shadow in) light emitted onto the display medium 1 by the reset light source section 33. Therefore unless resetting is carried out after the image writing light source section 32 has been returned to the standby position the whole of the display surface of the display medium 1 cannot be reset, and so the duration of resetting is extended by this amount.

Accordingly, in the present exemplary embodiment, the current position of the image writing light source section 32 is identified, so that resetting is carried out with time allocated between each of the divided electrodes. It should be noted that resetting with allocation of time between the electrodes is not only executed during the above described event (instruction to stop ongoing writing).

In the present exemplary embodiment one or other of the patterns of reset procedure during image writing 1 to 3 is executed as a procedure for rapid write image erasure.

For example, in the reset procedure during image writing 1, when the image writing light source section 32 faces the electrode 5C, moving of the image writing light source section 32 is stopped in this position, and first initialization processing (application of reset voltage and irradiation of reset light) is executed for the electrodes 5A and 5B on the upstream side. Then the image writing light source section 32 is returned to its standby position (in the opposite direction to that of the direction of arrow A in FIG. 2), and initialization processing (application or reset voltage and irradiation of reset light) for the electrode 5C is executed (see FIG. 11) at the point in time when the image writing light source section 32 exits from a state of facing the electrode 5C.

Figure 12:
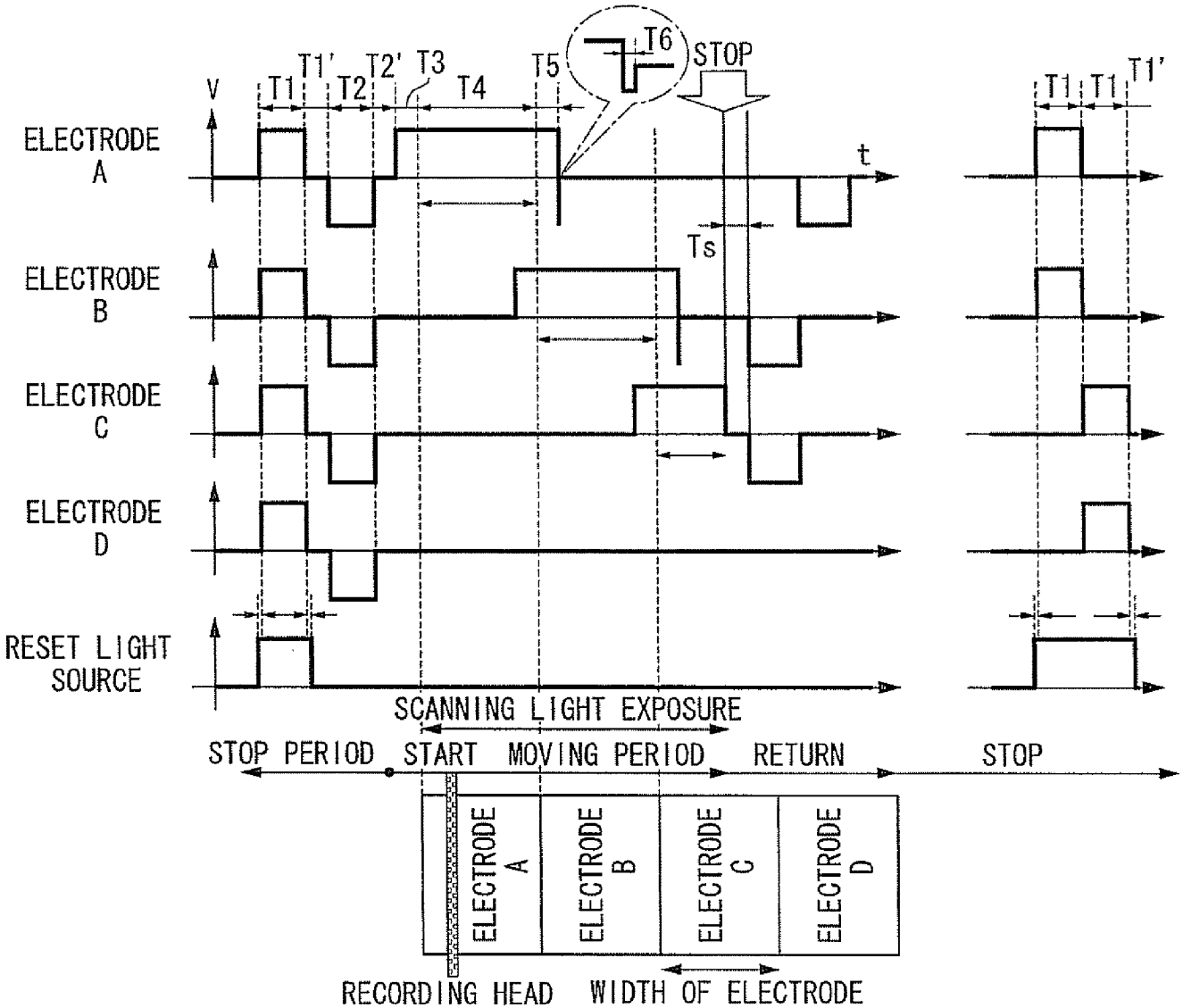
FIG. 12 is timing chart pertaining to a reset procedure during image writing 2.

In the reset procedure during image writing 2, initialization processing is split into a first stage (application of reset voltage) and a second stage (application of reset voltage and irradiation of reset light), and resetting is based mainly on rapid display image erasure by so-called dark resetting (see FIG. 12).

In addition, in reset procedure during image writing 3, initialization processing is executed in the array sequence of the divided electrodes while the image writing light source section 32 is being returned to the standby position (see FIG. 13).

Explanation will now be given below of the operation of the present exemplary embodiment.

Image Writing Procedure

First the controller 30 initializes the display medium 1 (sets to the uniform P texture state) with the reset light source section 33. When this is being undertaken, the image writing light source section 32 is disposed in the predetermined standby position before the image writing motion is started. This standby position is a position even further upstream than the edge portion of the display medium 1 at the upstream side in the direction of arrow A of FIG. 2, and is a position that does not face the display surface of the display medium 1.

When initialization of the display medium 1 is complete, the drive section 24 is next instructed to start moving the image writing light source section 32 in the direction of direction of arrow A of FIG. 2. The image writing light source section 32 starts moving from the standby position, and starts moving at a predetermined moving speed in the direction of arrow A of FIG. 2.

The controller 30 then instructs the switching section 28 to apply the image writing voltage to the electrode 5A for a specific duration of time at a point in time before the image writing light source section 32 has reached the edge portion of the electrode 5A at the upstream side in the direction of arrow A of FIG. 2.

Consequently, the switching section 28 applies the image writing voltage output for the electrode 5A from the high voltage pulse generation section 26B to the electrode 5A for the specific duration of time.

In a similar manner, the controller 30 instructs the switching section 28 to apply the image writing voltages to the electrodes 5B, 5C and 5D for specific durations at points in time before the image writing light source section 32 has reached the edge portions of the respective electrodes 5B, 5C and 5D at the upstream sides thereof in the direction of arrow A of FIG. 2.

Figure 10:
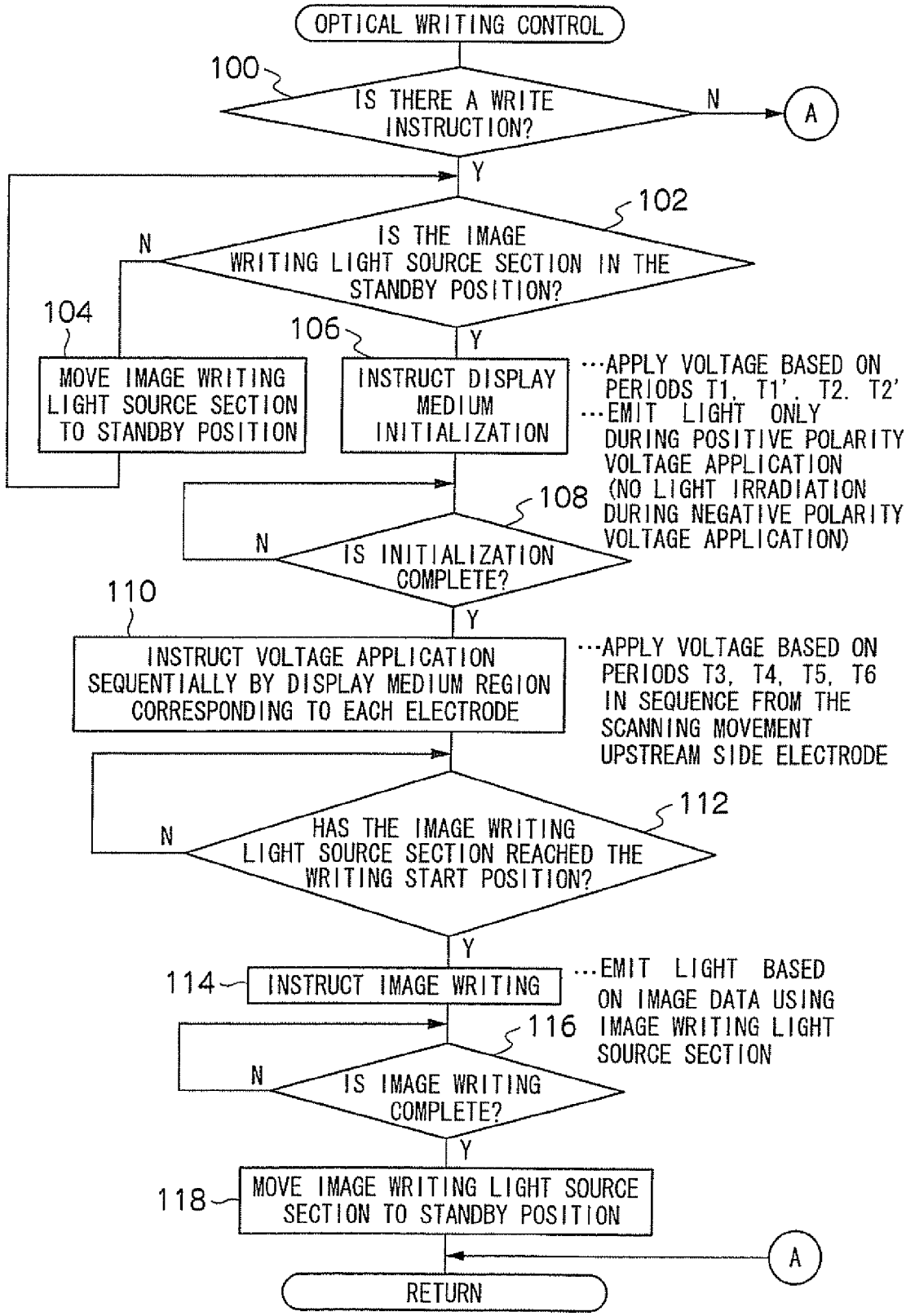
FIG. 10 is a flow chart showing an image writing procedure in a control unit.

A flow chart is shown in FIG. 10 showing more details of the above procedure for image writing in the controller 30.

Determination is made at step 100 as to whether or not writing has been instructed. When determination at step 100 is that writing has not been instructed the routine ends.

When determination is in the affirmative at step 100, the routine proceeds to step 102 and determination is made as to whether or not the image writing light source section 32 is positioned in the standby position, if not then the routine proceeds to step 104, and after the image writing light source section 32 has been moved to the standby position the routine moves to step 102.

When determination is affirmative at step 102 (determination is made that the image writing light source section 32 is in the standby position) the routine proceeds to step 106 and initialization of the display medium 1 is instructed.

When initialization is instructed at step 106, for example, voltage is applied based on the periods T1, T1', T2 and T2' shown in FIG. 11 (positive polarity voltage application to negative polarity voltage application), and light irradiation is executed in synchronization with the positive polarity voltage application period T1. It should be noted that light irradiation is not executed in the negative polarity voltage application period T2. The voltage application pattern here corresponds to the later described reset light irradiation procedure 2, however, the reset light irradiation procedure 1 may also be used. The P texture state is exhibited in the display layer 7 of the display medium 1 due to the initialization.

Determination is next made in step 108 as to whether or not initialization is completed, and when this is the case the routine proceeds to step 110, and instruction is given to apply voltage successively by each of the electrodes corresponding to the display medium 1.

When voltage application instruction is made at step 110, for example, voltage is executed based on the periods T3, T4, T5 and T6 shown in FIG. 11, from the electrode on the upstream side in the scanning moving direction (namely from the electrode 5A) to the electrode on the downstream side (namely through electrode 5B, electrode 5C to electrode 5D). The voltage in these regions becomes a voltage that is voltage Vpf or greater but less than Vfh due to this voltage application and the display layer 7 exhibits the F texture state. Next in step 112 determination is made as to whether or not the image writing light source section 32 has reached the writing position, and when this is the case the routine proceeds to step 114 and image writing is instructed.

When image writing is instructed at step 114 light is emitted onto the display medium 1 by the image writing light source section 32 according to image data, and the voltage of the irradiated positions becomes voltage Vfh or greater, the display layer 7 exhibits the P texture state, and an image is displayed (formed) on the display medium 1.

Determination is next made in step 116 as to whether or not the image writing has been completed, and when this is the case the routine proceeds to step 118, the image writing light source section 32 is moved to the standby position, and the routine is completed.

Reset Light Irradiation Procedure 1

In the present exemplary embodiment, when there is an image write instruction and the display medium 1 is being initially initialized (made into a uniform P texture state), the display medium 1 is made into the F texture state by application of the reset voltage (a voltage of Vpf or greater, but less than Vfh), and the partial resistance is made smaller by the reset light to give a high voltage (Vfh or above) and P texture state.

When this is carried out, as shown in FIG. 6A, positive polarity voltages and a negative polarity voltage are combined in a time series with executions of 100 msec each of positive polarity voltage application, negative polarity voltage application, and positive polarity voltage application in this order.

Reset light (light amount 200 μw/cm$^2$) is illuminated for 100 msec in synchronization with the positive polarity voltage applications of this series of reset voltage applications.

Figure 7:
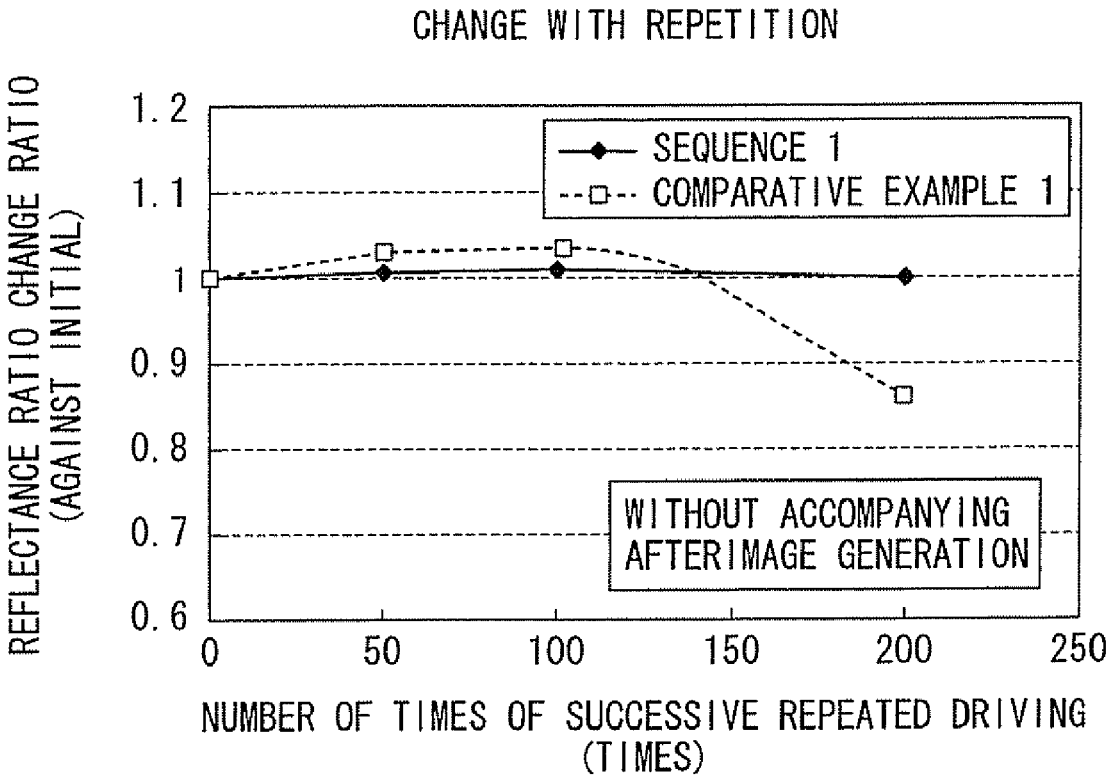
FIG. 7 is a graph showing the number of times successive driving is repeated against degree of reflectance ratio chance characteristics, in the reset light irradiation procedure 1 of FIG. 6A and in the Comparative Example 1 of FIG. 6B.

FIG. 7 is a graph showing characteristics of the number of times successive driving is repeated in the above reset light irradiation procedure 1 against degree of reflectance ratio change (solid line in FIG. 7).

Figure 6B:
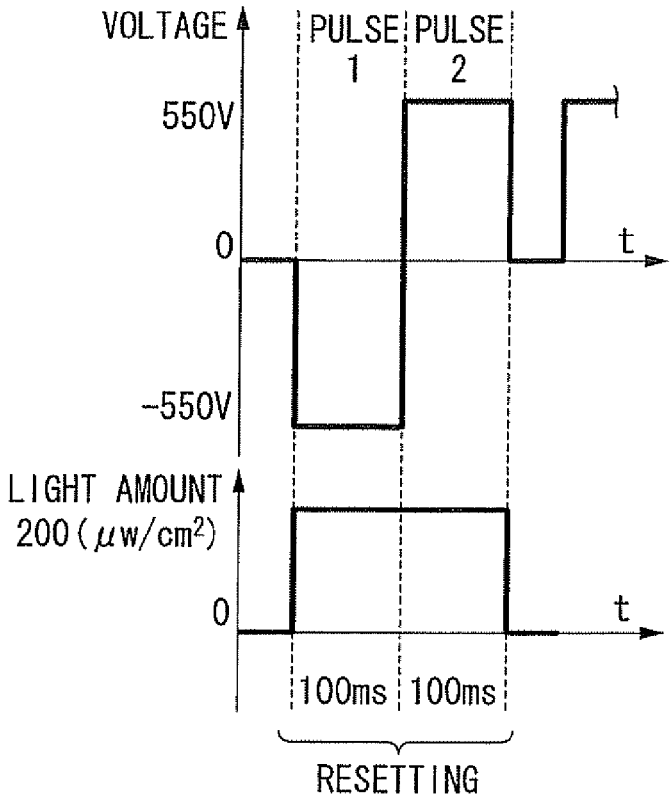
FIG. 6B is a timing chart for a Comparative Example 1 that is a comparison for FIG. 6A.

The vertical axis in FIG. 7 shows a ratio with the reflectance ratio in the initial state set at 1.0. The dashed line in the characteristic graph is a characteristic graph showing a case, as in FIG. 6B, where the reset voltage is a pattern of negative polarity voltage application and subsequent positive polarity voltage application (each of 100 msec), with reset light (light amount 200 μw/cm$^2$) emitted during all of the time of reset voltage application (a case referred to below as Comparative Example 1).

It can be seen from FIG. 7 that there is a small degree of change in the reflectance ratio (a figure of 1.0 is substantially maintained) in the present exemplary embodiment in which no reset light is emitted during the negative polarity reset voltage application period, in comparison to Comparative Example 1 in which there is a gradual reduction in reflectance ratio as the number of times successive repetition exceeds 100 times.

Reset Light Irradiation Procedure 2

Explanation will now be given of the reset light irradiation procedure 2.

When there is an image write instruction and the display medium 1 is being initially initialized (made into a uniform P texture state), the display medium 1 is made into the F texture state by application of the reset voltage (a voltage of Vpf or greater, but less than Vfh), and the partial resistance is made smaller by the reset light to give a high voltage (Vfh or above) and P texture state.

When this is carried out, as shown in FIG. 8A, a positive polarity voltage and a negative polarity voltage are combined in a time series with executions of 100 msec each of positive polarity voltage application to negative polarity voltage application.

Reset light (light amount 200 μw/cm$^2$) is illuminated for 100 msec in synchronization with the positive polarity voltage application of this series of reset voltage applications.

Figure 9:
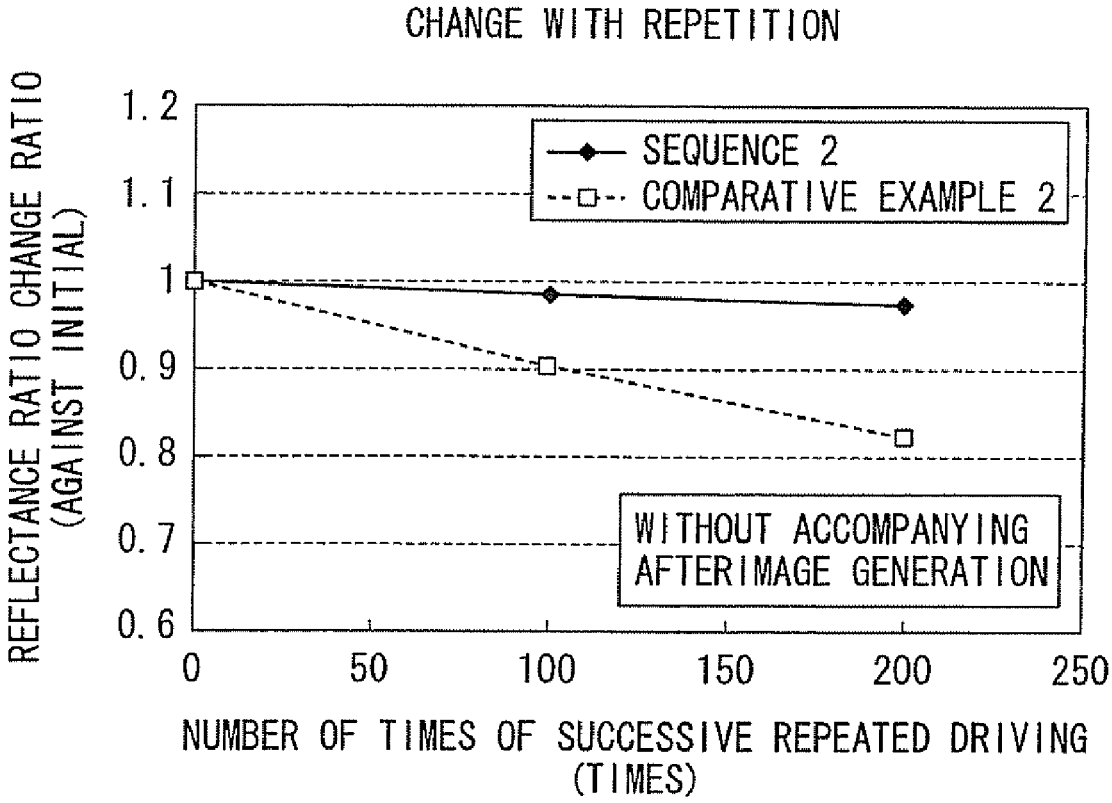
FIG. 9 is a graph showing the number of times successive driving is repeated against degree of reflectance ratio change characteristics, in the reset light irradiation procedure 2 and in the Comparative Example 2 of FIG. 8A.

FIG. 9 is a graph showing characteristics of the number of times successive driving is repeated against degree of reflectance ratio change (solid line in FIG. 9) in the above reset light irradiation procedure 2.

Figure 8B:
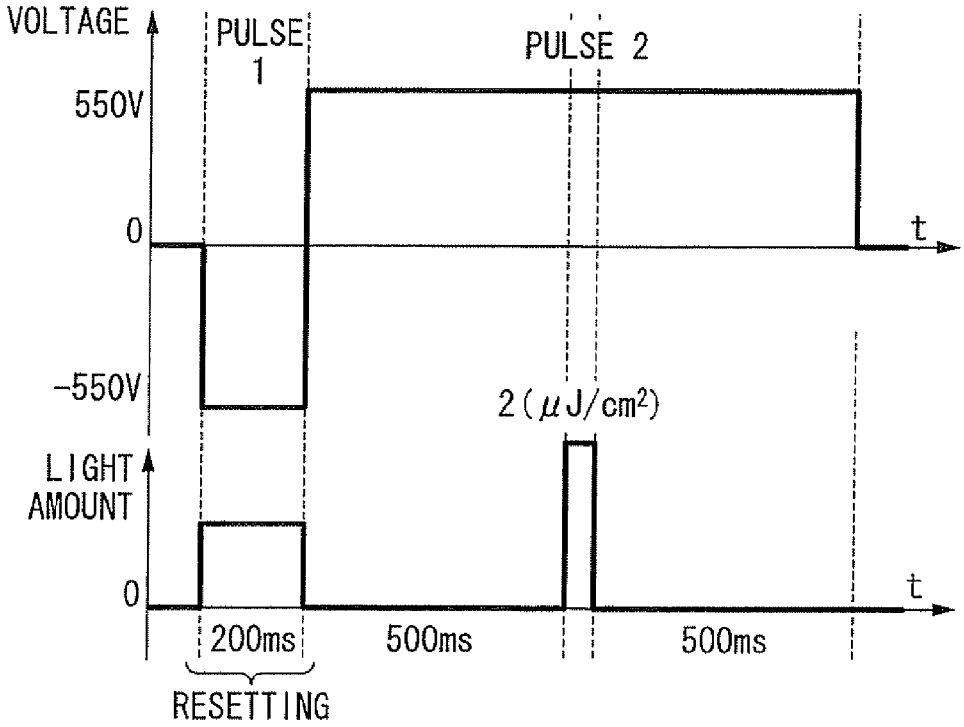
FIG. 8B is a timing chart for a Comparative Example 2 that is a comparison for FIG. 8A.

The vertical axis in FIG. 9 shows a ratio with the reflectance ratio in the initial state set at 1.0. The dashed line in the characteristic graph is a characteristic graph showing a case, like in FIG. 8B, where the reset voltage is a negative polarity voltage application of 100 msec, with reset light (light amount 200 μw/cm$^2$) emitted during this negative polarity reset voltage application (a case referred below to as Comparative Example 2).

It can be seen from FIG. 9 that there is a small decree of change in the reflectance ratio (a figure of 1.0 is substantially maintained) in the present exemplary embodiment in which no reset light is emitted during the negative polarity reset voltage application period, in comparison to Comparative Example 2 in which there is a gradual decrease in the reflectance ratio from the initial value as the number of times successive repeating increases.

Reset Procedure During Image Writing 1

FIG. 11 is timing chart showing a full face reset procedure during image writing 1 to the display medium 1 (FIG. 11 is when the image writing light source section 32 corresponds to the electrode 5C), and writing is caused to stop during image writing.

First initialization is executed at the same time for all of electrodes 5A, 5B, 5C and 5D. The initialization uses a pattern based on the previously described reset light irradiation procedure 2, i.e., (positive polarity voltage application+reset light irradiation) to negative polarity voltage application+no reset light irradiation). It should be noted that while there is a no-voltage-application period T1' set between the positive polarity voltage application period T1 and the negative polarity voltage application period T2, this period T1' is not particularly essential.

Also, only with respect to this resetting during image writing, reset light may be emitted during the negative polarity voltage application period.

When the above initialization is completed and a period T2' has passed, image writing voltage is first applied to the electrode 5A. The duration of this image writing voltage application is T3+T4+T5, of which the central time band T4 corresponds to the electrode 5A. When positive polarity voltage application is completed for each of the electrodes a negative polarity voltage application is executed for a brief duration T6.

Since the electrodes 5A, 5B, 5C and 5D are disposed adjacent to each other, the voltage application timings to each of the electrodes 5A, 5B, 5C and 5D are such that application control mutually overlaps the times of voltage application so the start of voltage application is during the positive polarity voltage application of the period T4 for the electrode on the upstream side.

Table 1 shows standard durations for each of the periods T1, T1', T2, T2', T3, T4, T5 and T6 of each voltage application.

TABLE 1

| Period | Standard Duration (msec) | Standard Voltage (V) |
|---|---|---|
| T1 | 200 | +650 |
| T1' | 10 | 0 |
| T2 | 200 | −650 |
| T2' | 10 | 0 |
| T3 | 50 | +650 |
| T4 | 700 | |
| T5 | 200 | |
| T6 | 2 | −200 |

The image writing light source section 32 starts moving in synchronization with the above image writing voltage application (moves in the direction of arrow A in FIG. 2) and emits light according to the image data.

When the region of electrode 5A is completed then the image writing continues in the next region electrode 5B.

With respect to this, if there is an instruction to stop image writing before image writing is completed for all of the regions of the electrodes 5A, 5B, 5C and 5D, first the motion of the image writing light source section 32 is stopped.

Next, the current position of the image writing light source section 32 (which of the electrodes 5A, 5B, 5C and 5D the image writing light source section 32 is facing) is identified. FIG. 11 is for a case where writing is stopped over the electrode 5C.

The instruction to stop during writing is when writing of the regions electrodes 5A and 5B is already completed, enabling a visible state. Initialization processing, i.e., (positive polarity voltage application+reset light irradiation) to (negative polarity voltage application+no reset light irradiation), is executed to the electrodes 5A and 5B.

When initialization processing is completed for electrodes 5A and 5B the image in the electrodes 5A and 5B is erased.

Next motion is started to return the image writing light source section 32 to the standby position (in the opposite direction to that of arrow A in FIG. 2). When it is identified in this motion that the image writing light source section 32 has exited from the electrode 5C, initialization processing, i.e., (positive polarity voltage application+reset light irradiation) to (negative polarity voltage application+no reset light irradiation), is executed for this electrode 5C.

The image in the region of the electrode 5C is erased when the initialization processing of the electrode 5C is completed. Rapid image erasure is completed in response to the instruction to stop during writing by the above. There is obviously no need to carry out the initialization processing at the downstream side of the electrode 5C, namely the electrode 5D in this case, since the electrode 5D is prior to image writing.

Reset Procedure During Image Writing 2

FIG. 12 is timing chart showing a full face reset procedure during image writing 2 to the display medium 1 (FIG. 12 is when the image writing light source section 32 corresponds to the electrode 5C), and writing is caused to stop during image writing.

First initialization is executed at the same time for all of electrodes 5A, 5B, 5C and 5D. The initialization uses a pattern based on the previously described reset light irradiation procedure 2, i.e., (positive polarity voltage application+reset light irradiation) to (negative polarity voltage application+no reset light irradiation). It should be noted that while there is a no-voltage-application period T1' set between the positive polarity voltage application period T1 and the negative polarity voltage application period T2, the period T1' is not particularly essential.

Also, only with respect to this resetting during image writing, reset light may be emitted during the negative polarity voltage application period.

When the above initialization is completed and a period T2' has passed, image writing voltage is first applied to the electrode 5A. The duration of this image writing voltage application is T3+T4+T5, and the image writing light source section 32 corresponds to the electrode 5A during the central time band thereof T4. When positive polarity voltage application is completed for each of the electrodes a negative polarity voltage application is executed for a brief duration T6. The standard durations and voltages for each of the periods are the same as those in the above Table 1.

The image writing light source section 32 starts moving in synchronization with the above image writing voltage application (in the direction of arrow A in FIG. 2) and emits light according to the image data.

When the region of electrode 5A is completed then the image writing continues in the next region, electrode 5B.

With respect to this, if there is an instruction to stop image writing before image writing is completed for all of the regions of the electrodes 5A, 5B, 5C and 5D, first the motion of the image writing light source section 32 is stopped.

Next the current position of the image writing light source section 32 (which of the electrodes 5A, 5B, 5C and 5D the image writing light source section 32 is facing) is identified. FIG. 12 is for a case where writing is stopped over the electrode 5C.

The instruction to stop during writing is when writing of the regions electrodes 5A and 5B is already completed, and writing in the region of electrode 5C is ongoing, enabling a visible state.

First motion is started to return the image writing light source section 32 to the standby position (in the opposite direction to that of arrow A in FIG. 2).

At the same time as this motion (without regard to the movement state) a first stage of initialization processing is executed (application of a negative polarity voltage) for the electrodes 5B and 5C.

In this case a power source configuration is envisaged with the maximum number of individual electrodes that are controllable at the same time being 2, and after performing the first stage initialization processing to the electrodes 5B and 5C, initialization processing is performed to the remaining electrode 5A (initialization can be omitted for the electrode 5D since image writing had not been carried out thereto originally).

In the first stage of initialization processing, processing can be carried out without regard to the position of the image writing light source section 32 since it is so-called dark resetting (F texture state) in which reset light is not used at all.

When the initialization processing is completed for the electrodes 5B and 5C, dark resetting is next executed for the electrode 5A and all of the image is erased in this state.

Then a second stage of initialization processing is executed after the image writing light source section 32 has returned to the standby position. This second stage of initialization processing is a positive polarity voltage application+reset light irradiation. FIG. 13 envisages a case in which there are a maximum of 2 individual electrodes that are controllable at the same time and voltage application is performed in a time-series with units of two individual electrodes (first for the electrodes 5A and 5B, and then for the electrodes 5C and 5D) and reset light irradiation continues for this period of time.

Rapid image erasure is completed in response to the instruction to stop during writing by the above. If the maximum number of individual electrodes controllable at the same time is 4 then all of the electrodes 5A, 5B, 5C and 5D may be dark reset (first stage initialization processed) at the same time, and then the second stage of initialization processing (positive polarity voltage application+reset light irradiation) may be carried out at the same time.

Reset Procedure During Image Writing 3

FIG. 13 is timing chart showing a full face reset procedure during image writing 1 to the display medium 1 (FIG. 13 is when the image writing light source section 32 faces the electrode 5C), and writing is caused to stop.

First initialization is executed at the same time for all of electrodes 5A, 5B, 5C and 5D. The initialization uses a pattern based on the previously described reset light irradiation procedure 2, i.e., (positive polarity voltage application+reset light irradiation) to (negative polarity voltage application+no reset light irradiation). It should be noted that while there is a no-voltage-application period T1' set between the positive polarity voltage application period T1 and the negative polarity voltage application period T2, the period T1' is not particularly essential.

Also, only with respect to this resetting during image writing, reset light may be emitted during the negative polarity voltage application period.

When the above initialization is completed and a period T2' has passed, image writing voltage is first applied to the electrode 5A. The duration of this image writing voltage application is T3+T4+T5, and the image writing light source section 32 corresponds to the electrode 5A during the central time band thereof T4. When positive polarity voltage application is completed for each of the electrodes a negative polarity voltage application is executed for a brief duration T6. The standard durations and voltages for each of the periods are the same as those in the above Table 1.

The image writing light source section 32 starts moving in synchronization with the above image writing voltage application (in the direction of arrow A in FIG. 2) and emits light according to the image data.

When the region of electrode 5A is completed then the image writing continues in the next region, electrode 5B.

With respect to this, if there is an instruction to stop image writing before image writing is completed for all of the regions of the electrodes 5A, 5B, 5C and 5D, first the motion of the image writing light source section 32 is stopped.

Next the current position of the image writing light source section 32 (which of the electrodes 5A, 5B, 5C and 5D the image writing light source section 32 is facing) is identified. FIG. 13 is for a case where writing is stopped over the electrode 5C.

Since the instruction to stop during writing is when writing of the regions electrodes 5A and 5B is already completed, and writing in the region of electrode 5C is finished when it was still ongoing, enabling a visible state.

First motion is started to return the image writing light source section 32 to the standby position (in the opposite direction to that of arrow A in FIG. 2). The initialization processing, i.e., (positive polarity voltage application+reset light irradiation) to (negative polarity voltage application+no reset light irradiation), is executed to the electrode 5C when it is identified in this motion that the image writing light source section 32 has exited the electrode 5C.

As the movement of the image writing light source section 32 continues, next the initialization processing, i.e., (positive polarity voltage application+reset light irradiation) to (negative polarity voltage application+no reset light irradiation), is executed to the electrode 5B when it is identified that the image writing light source section 32 has exited the electrode 5B.

As the movement of the image writing light source section 32 continues further, the initialization processing, i.e., (positive polarity voltage application+reset light irradiation) to (negative polarity voltage application+no reset light irradiation), is executed to the electrode 5A when it is identified that the image writing light source section 32 has exited the electrode 5A (namely, reached the standby position).

The image in the regions of the electrodes 5A, 5B, and 5C is erased when the initialization processing for the electrode 5A is completed. Rapid image erasure is completed in response to the instruction to stop during writing by the above. There is no need to carry out the initialization processing at the downstream side of the electrode 5C, namely the electrode 5D in this case, since the electrode 5D is prior to image writing.

It should be noted that whereas explanation has been given of a case using a cholesteric liquid crystal for the display layer in the present exemplary embodiment, there is no limitation thereto, and a strong dielectric liquid crystal may be used.

Also, in the present exemplary embodiment a configuration is used with the display medium 1 being in a fixed state and the image writing light source section 32 being moved with relative movement to the display medium 1, however configurations in which the image writing light source section 32 is in a fixed state and the display medium 1 is moved, or in which both elements are moved, may also be used.

In addition explanation has been given in the present exemplary embodiment of a case with four individual electrodes, however there is no limitation thereto and the principal of irradiating a reset light source only when the reset voltage is of positive polarity does not require the electrode to be divided. Furthermore the measures adopted in response to a stop instruction during writing are applicable as long as there are two or more electrodes.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An optical writing image forming device comprising:

a positioning section that includes a drive section and a controller, the positioning section positioning an image writing light source head with respect to an optically written display medium, the optically written display medium comprising a pair of electrodes with at least one of which is formed by a group of a plurality of sub-electrodes electrically separated from each other and disposed along one direction, a display layer that changes in reflectance ratio according to voltage applied between the pair of electrodes, and a photoconductor layer capable of voltage modulation by light irradiation, changing the reflectance ratio of the display layer;

a display layer initialization section having an initialization light source capable of irradiating initialization light, the display layer initialization section being configured to apply an initialization voltage between the pair of electrodes and initialization light irradiation at the same time over the entire region of the photoconductor layer using the initialization light source, in order to initialize the display layer to give a uniform reflectance ratio; and an optical writing section having the image writing light source head that is capable of scanning movement in a space between the initialization light source and the optically written display medium, the optical writing section being positioned by the positioning section and is configured to carry out light irradiation according to image information, the optical writing section executing the scanning movement of the image writing light source head along an array direction of the sub-electrode group after the display layer has been given the uniform reflectance ratio by the initialization voltage application and the initialization light irradiation using the display layer initialization section;

wherein the positioning section identifies which of the sub-electrodes corresponds to the position of the image writing light source head during the scanning movement when a case arises in which it is necessary to stop ongoing light irradiation by the optical writing section according to the image information; and the display layer initialization section, based on information about the position of the image writing light source head identified by the positioning section, erases in a time-series at least writing information in the display layer corresponding to the group of the plurality of sub-electrodes by selecting the sub-electrodes in sequence so that the image writing light source head does not obstruct light emitted from the initialization light source while the image writing head light source is being returned to a standby position.

2. The optical writing image forming device of claim 1, wherein the display layer initialization section prioritizes the sub-electrodes that have already been completely passed by the scanning movement of the image writing light source head in the group of the plurality of sub-electrodes, executing the initialization voltage application and the initialization light irradiation to the sub-electrodes that have already been completely passed before executing the initialization voltage application and the initialization light irradiation to the sub-electrode identified corresponding to the position of the image writing light source head by the positioning section.

3. The optical writing image forming device of claim 1, wherein the display layer initialization section applies an initialization voltage at a first stage, and simultaneously irradiates the entire region of the photoconductor layer with the initialization light irradiation after the image writing head has returned to the standby position using the initialization light source.

4. A control device for an optical writing image forming device comprising:

a display layer initialization section that, at an optically written display medium, applies an initialization voltage between a pair of electrodes and initialization light irradiation at the same time over the entire region of a photoconductor layer using an initialization light source, in order to initialize a display layer to give a uniform reflectance ratio, the optically written display medium comprising the pair of electrodes, at least one of which is formed by a group of a plurality of sub-electrodes electrically separated from each other and disposed along one direction, the display layer, which changes in reflectance ratio according to voltage applied between the pair of electrodes, and the photoconductor layer, which is capable of voltage modulation by light irradiation, thereby changing the reflectance ratio of the display layer;

an optical writing section that executes a scanning movement of an image writing light source head carrying out light irradiation according to image information, the scanning movement being along the array direction of the sub-electrode group and being carried out after the display layer has been given the uniform reflectance ratio by the initialization voltage application and the initialization light irradiation using the display layer initialization section;

an image writing light source head position identification section that identifies which of the sub-electrodes corresponds to the position of the image writing light source head during the scanning movement when a case arises in which it is necessary to stop ongoing light irradiation according to the image information by the by the optical writing section section; and a writing information erasing section that, based on information identified by the image writing light source head position identification section, erases in a time-series at least writing information in the display layer corresponding to the group of the plurality of sub-electrodes by selecting the sub-electrodes in sequence so that the image writing light source head does not obstruct light emitted from the initialization light source while the image writing head light source is being returned to a standby position.

5. The control device for an optical writing image forming device of claim 4, wherein the writing information erasing section prioritizes the sub-electrodes that have already been completely passed by the scanning movement of the image writing light source head in the group of the plurality of sub-electrodes, executing the initialization voltage application and the initialization light irradiation to the sub-electrodes that have already been completely passed before executing the initialization voltage application and the initialization light irradiation to the sub-electrode identified corresponding to the position of the image writing light source head by the image writing light source head position identification section.

6. The control device for an optical writing image forming device of claim 4, wherein the writing information erasing section applies an initialization voltage at a first stage, and simultaneously irradiates the entire region of the photoconductor layer with the initialization light irradiation after the image writing head has returned to the standby position using the initialization light source.

7. An optical writing image forming device forming an image on an optically written display medium comprising a pair of electrodes with at least one of which is formed by a group of a plurality of sub-electrodes electrically separated from each other and disposed along one direction, a display layer that changes in reflectance ratio according to voltage applied between the pair of electrodes, and a photoconductor layer capable of voltage modulation by light irradiation, changing the reflectance ratio of the display layer, the device comprising:

a positioning section that includes a drive section and a controller, the positioning section positioning an image writing light source head with respect to the optically written display medium;

a display layer initialization section having an initialization light source capable of irradiating initialization light, the display layer initialization section being configured to apply an initialization voltage between the pair of electrodes and initialization light irradiation at the same time over the entire region of the photoconductor layer using the initialization light source, in order to initialize the display layer to give a uniform reflectance ratio; and an optical writing section having the image writing light source head that is capable of scanning movement in a space between the initialization light source and the optically written display medium, the optical writing section being positioned by the positioning section and is configured to carry out light irradiation according to image information, the optical writing section executing the scanning movement of the image writing light source head along an array direction of the sub-electrode group after the display layer has been given the uniform reflectance ratio by the initialization voltage application and the initialization light irradiation using the display layer initialization section;

wherein the positioning section identifies which of the sub-electrodes corresponds to the position of the image writing light source head during the scanning movement when a case arises in which it is necessary to stop ongoing light irradiation by the optical writing section according to the image information; and the display layer initialization section, based on information about the position of the image writing light source head identified by the positioning section, erases in a time-series at least writing information in the display layer corresponding to the group of the plurality of sub-electrodes by selecting the sub-electrodes in sequence so that the image writing light source head does not obstruct light emitted from the initialization light source while the image writing head light source is being returned to a standby position.

8. The optical writing image forming device of claim 7, wherein the display layer initialization section prioritizes the sub-electrodes that have already been completely passed by the scanning movement of the image writing light source head in the group of the plurality of sub-electrodes, executing the initialization voltage application and the initialization light irradiation to the sub-electrodes that have already been completely passed before executing the initialization voltage application and the initialization light irradiation to the sub-electrode identified corresponding to the position of the image writing light source head by the positioning section.

9. The optical writing image forming device of claim 7, wherein the display layer initialization section applies an initialization voltage at a first stage, and simultaneously irradiates the entire region of the photoconductor layer with the initialization light irradiation after the image writing head has returned to the standby position using the initialization light source.

* * * * *